US009932194B2

(12) United States Patent
Tokuma

(10) Patent No.: US 9,932,194 B2
(45) Date of Patent: Apr. 3, 2018

(54) SHEET DISCHARGE APPARATUS AND IMAGE FORMING APPARATUS HAVING SAME

(71) Applicant: CANON KABUSHIKI KAISHA, Tokyo (JP)

(72) Inventor: Naoto Tokuma, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/219,517

(22) Filed: Jul. 26, 2016

(65) Prior Publication Data

US 2017/0036879 A1 Feb. 9, 2017

(30) Foreign Application Priority Data

Aug. 4, 2015 (JP) ..... 2015-154004

(51) Int. Cl.
*B65H 31/10* (2006.01)
*B65H 43/00* (2006.01)
(Continued)

(52) U.S. Cl.
CPC ..... *B65H 31/10* (2013.01); *B65H 29/14* (2013.01); *B65H 29/68* (2013.01); *B65H 31/18* (2013.01);
(Continued)

(58) Field of Classification Search
CPC ..... B65H 29/14; B65H 31/10; B65H 29/68; B65H 2513/10
See application file for complete search history.

(56) References Cited

U.S. PATENT DOCUMENTS 8,315,550 B2 * 11/2012 Pinney ..... B65H 33/10 271/207
8,585,044 B2 * 11/2013 Matsui ..... G03G 15/6552 271/176
(Continued)

FOREIGN PATENT DOCUMENTS

JP 10226446 A * 8/1998
JP H10-226446 A 8/1998
JP 2009-113958 A 5/2009

OTHER PUBLICATIONS

Search Report issued in corresponding Great Britian Application No. GB1612953.8 dated Jan. 17, 2017.

*Primary Examiner* — Jeremy R Severson
(74) *Attorney, Agent, or Firm* — Fitzpatrick, Cella, Harper & Scinto

(57) ABSTRACT

A sheet discharge apparatus includes a sheet stacking portion on which a sheet discharged by a discharging portion is stacked, and a control portion configured to control a moving unit such that a height position of an uppermost sheet stacked on the sheet stacking portion becomes a first height position. In a case where a sheet detection portion detects that the height position of the uppermost sheet is above a second height position, the control portion sets a sheet discharge speed of the discharging portion to a first sheet discharge speed. In a case where the sheet detection portion detects that the height position of the uppermost sheet becomes lower than the second height position, the control portion controls the sheet discharge speed to be a second sheet discharge speed faster than the first sheet discharge speed.

11 Claims, 19 Drawing Sheets

(51) Int. Cl.

| | |
|---|---|
| ***B65H 29/68*** | (2006.01) |
| ***B65H 29/14*** | (2006.01) |
| ***B65H 31/18*** | (2006.01) |
| ***B65H 31/30*** | (2006.01) |
| ***B65H 43/08*** | (2006.01) |

(52) U.S. Cl.

CPC ..... *B65H 31/3027* (2013.01); *B65H 43/00* (2013.01); *B65H 43/08* (2013.01); *B65H 2301/4212* (2013.01); *B65H 2301/4213* (2013.01); *B65H 2404/1442* (2013.01); *B65H 2404/1521* (2013.01); *B65H 2511/10* (2013.01); *B65H 2511/152* (2013.01); *B65H 2511/30* (2013.01); *B65H 2511/51* (2013.01); *B65H 2511/515* (2013.01); *B65H 2513/10* (2013.01); *B65H 2513/40* (2013.01); *B65H 2513/512* (2013.01); *B65H 2553/412* (2013.01); *B65H 2701/182* (2013.01); *B65H 2701/18292* (2013.01); *B65H 2801/27* (2013.01)

(56) References Cited

U.S. PATENT DOCUMENTS

| | | | | |
|---|---|---|---|---|
| 9,036,165 | B2 * | 5/2015 | Osakabe ..... | H04N 1/00588 358/1.12 |
| 2011/0215520 | A1 * | 9/2011 | Tsuchiya ..... | B65H 31/12 271/209 |
| 2015/0246560 | A1 * | 9/2015 | Nakamura ..... | B65H 29/68 271/182 |

* cited by examiner

FIG.17

| NUMBER OF STAPLE BUNDLE | HEIGHT OF SHEET SURFACE | SHEET BUNDLE DISCHARGE SPEED | | |
|---|---|---|---|---|
| | | 400mm/s | 550mm/s | 700mm/s |
| 10 SHEETS | DESIGN | ○ | ○ | ○ |
| | −10mm | ○ | ○ | ○ |
| | −30mm | × | ○ | ○ |
| | −50mm | × | ○ | ○ |
| 50 SHEETS | NOMINAL | ○ | ○ | ○ |
| | −10mm | × | ○ | ○ |
| | −30mm | × | ○ | ○ |
| | −50mm | × | ○ | ○ |
| 100 SHEETS | NOMINAL | ○ | ○ | ○ |
| | −10mm | × | ○ | ○ |
| | −30mm | × | ○ | ○ |
| | −50mm | × | × | ○ |

SHEET DISCHARGE APPARATUS AND IMAGE FORMING APPARATUS HAVING SAME

BACKGROUND OF THE INVENTION

Field of the Invention

This disclosure relates to a sheet discharge apparatus, a sheet processing apparatus, and an image forming apparatus.

Description of the Related Art

In general, there is known an image forming apparatus which discharges a sheet, on which an image is formed, by a sheet discharge apparatus and stacks the sheet on a discharge tray. In addition, a sheet processing apparatus may be provided in the image forming apparatus to perform a binding process on the sheet where the image is formed. In this case, the sheet on which the image is formed is conveyed to the sheet processing apparatus to be subjected to the binding process, and then a sheet bundle is discharged by the sheet discharge apparatus and stacked on the tray.

Hitherto, JP-A-2009-113958 discloses such a sheet discharge apparatus in which, when the sheet bundle subjected to the binding process is discharged, a sheet discharge speed is accelerated in order that a binding portion of the discharged sheet bundle does not interfere with the binding portion of the already-stacked sheet bundle.

By the way, when a predetermined amount of sheets are stacked on the tray stacked with the discharged sheet or the sheet bundle (even in a case where sheets are bound in a sheet bundle and discharged, there is no difference in that the sheet is discharged, and thus in the following it is assumed that the sheet bundle is also included in the meaning of the sheet if there is no specific mention about the sheet bundle or the sheet separated one by one), the tray descends to enable the next sheet to be stacked. Then, after the tray descends, the next sheet is discharged and sequentially the sheet is stacked on the tray. However, the sheets to be stacked on the tray is limited in amount, and thus when the stacking amount of the sheets stacked on the tray is in a full loaded state up to the limit of the tray, the sheet processing apparatus and the image forming apparatus are stopped. In this case, when the sheet is removed by a user, the tray is raised. When the raised tray is returned to a home position, the sheet processing apparatus and the image forming apparatus are reactivated, and the sheet is discharged onto the tray.

In order to prevent that the sheet processing apparatus and the image forming apparatus are stopped at the time of the full loaded state, or in order to temporally check the stacked sheet, the user may remove the stacked sheet during operation. Even in a case where the stacked sheet is removed during operation as described above, the sheet discharge apparatus disclosed in JP-A-2009-113958 already described above keeps on discharging the next sheet bundle at the increased sheet discharge speed in order that the binding portion of the discharged sheet bundle interferes with the binding portion of the stacked sheet bundle.

Herein, in a case where the stacked sheet is removed, the height position of the uppermost surface of the sheet on the tray is lowered. In this state, when the sheet is discharged, the leading end of the discharged sheet is hung down a lot. When the hanging-down amount of the leading end of the sheet is large, an abutting angle formed between the leading end and the uppermost surface of the sheet becomes large compared to that before the stacked sheet is removed. It is noted that, in a case where all the stacked sheets are removed, the abutting angle formed between the leading end of the sheet and the sheet stack surface of the tray becomes large.

Then, when the abutting angle becomes large, a discharge resistance between the leading end of the sheet and the sheet on the tray becomes large. When the discharge resistance becomes large, strength (stiffness) of the sheet becomes small compared to the resistance, and thus the sheet is buckled. As a result, the trailing end of the sheet leans onto a sheet discharge unit, and a paper jam occurs.

SUMMARY OF THE INVENTION

According to a first aspect of this disclosure, a sheet discharge apparatus includes a discharging portion configured to discharge a sheet, a sheet stacking portion, configured to be moved up and down, on which the sheet discharged by the discharging portion is stacked, a moving unit configured to move the sheet stacking portion, a control portion configured to control the moving unit such that a height position of an uppermost sheet stacked on the sheet stacking portion becomes a first height position, and a sheet detection portion configured to detect that the height position of the uppermost sheet becomes lower than a second height position lower than the first height position. The control portion sets a sheet discharge speed of the discharging portion to a first sheet discharge speed in a case where the uppermost sheet is at the first height position. The control portion controls the sheet discharge speed to be a second sheet discharge speed faster than the first sheet discharge speed if the sheet detection portion detects that the height position of the uppermost sheet becomes lower than the second height position.

According to a second aspect of this disclosure, a sheet discharge apparatus includes an image forming portion configured to form an image in a sheet, a discharging portion configured to discharge the sheet on which the image formed by the image forming portion, a sheet stacking portion, configured to be moved up and down, on which the sheet discharged by the discharging portion is stacked, a moving unit configured to move the sheet stacking portion, a control portion configured to control the moving unit such that a height position of an uppermost sheet stacked on the sheet stacking portion becomes a first height position, and a sheet detection portion configured to detect that the height position of the uppermost sheet becomes lower than a second height position lower than the first height position. The control portion sets a sheet discharge speed of the discharging portion to a first sheet discharge speed in a case where the sheet detection portion detects that the height position of the uppermost sheet is above the second height position. The control portion controls the sheet discharge speed to be a second sheet discharge speed faster than the first sheet discharge speed in a case where the sheet detection portion detects that the height position of the uppermost sheet is below the second height position.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

BRIEF DESCRIPTION OF THE DRAWINGS

FIG. 14A is a diagram illustrating a state when the lower tray is at a position where a second detecting portion is turned off and a third detecting portion is turned on.

FIG. 14B is a diagram illustrating a state when the sheet bundle stacked on the lower tray is at a position where the second detecting portion is turned off and the third detecting portion is turned on.

FIG. 14C is a diagram illustrating a state when the lower tray is at a position where the third detecting portion is turned on.

FIG. 17 is a table showing an experiment result on a relation between the number of staple bundles, a height of a stack surface, a bundle discharge speed, a defect of a stacking property, and an occurrence of a paper jam in the sheet discharge apparatus.

DESCRIPTION OF THE EMBODIMENTS

Figure 1:
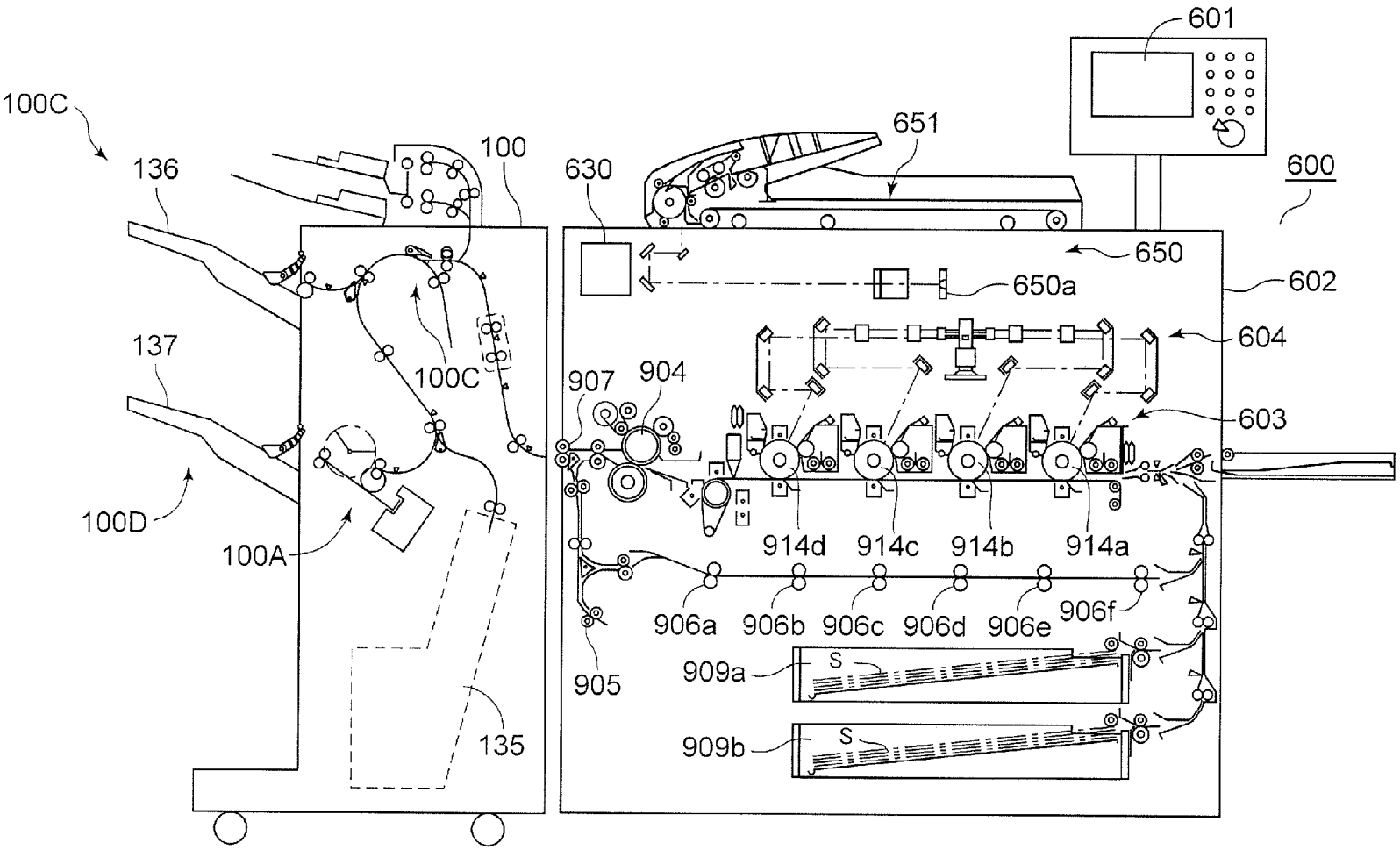
FIG. 1 is a diagram illustrating a configuration of a color copier which is an example of an image forming apparatus which is provided with a sheet processing apparatus equipped with a sheet discharge apparatus according to a first embodiment.

Hereinafter, embodiments of this disclosure will be described in detail with the drawings. FIG. 1 is a diagram illustrating a configuration of a color copier which is an example of an image forming apparatus which is provided with a sheet processing apparatus equipped with a sheet discharge apparatus according to a first embodiment of this disclosure. As illustrated in FIG. 1, there is provided an document conveying apparatus 651 which is used to automatically read a plurality of documents on the upper surface of a color copier body (hereinafter, referred to as a copier body) 602 of a color copier 600. On the upper portion of the copier body 602, a document reading unit (an image reader) 650 is provided.

The copier body 602 is provided with sheet feeding cassettes 909*a* and 909*b* in which a normal sheet S for forming an image is stacked, an image forming portion 603 which forms a toner image on the sheet using an electrophotographic process, and a fixing portion 904 which fixes the toner image formed in the sheet. In addition, an operating unit 601 is provided in the upper surface of the copier body 602, through which a user inputs/sets various data in the copier body 602. Further, in the side of the copier body 602, a finisher 100 serving as the sheet processing apparatus is connected. Furthermore, at a predetermined position of the copier body 602, there is provided a CPU circuit portion 630 which is a control portion for the control of the copier body 602 and the finisher 100.

In the color copier 600 described above, when an image of the document (not illustrated) is formed in the sheet, the image of the document conveyed by the document conveying apparatus 651 is firstly read out using an image sensor 650*a* provided in the document reading unit 650. Thereafter, the read-out digital data is input to an exposing portion 604. The exposing portion 604 irradiates a photoconductive drum 914 (914*a* to 914*d*) provided in the image forming portion 603 with light according to the digital data. When the light is emitted as described, an electrostatic latent image is formed in the surface of the photoconductive drum. Developing the electrostatic latent image, the toner images of the respective colors (yellow, magenta, cyan, and black) are formed in the surface of the photoconductive drum.

Next, the toner image of the four colors are transferred onto the sheet fed from the sheet feeding cassettes 909*a* and 909*b*. Thereafter, the toner image transferred on the sheet is fixed by the fixing portion 904. After the toner image is fixed, the sheet keeps going on to be discharged from an upper sheet discharge roller pair 907 to the finisher 100 connected to the side of the copier body 602 in the case of a simplex mode of forming the image on one side of the sheet.

In the case of a duplex mode of forming the image on two sides of the sheet, the sheet is conveyed from the fixing portion 904 to a reverse roller 905. Thereafter, the reverse roller 905 is reversed at a predetermined timing and the sheet is conveyed in a direction toward two-sides conveyance rollers 906*a* to 906*f*. Next, the sheet is conveyed again to the image forming portion 603. The toner images of four colors (yellow, magenta, cyan, and black) are transferred onto the rear surface of the sheet. The sheet of which the rear surface is transferred with the four-color toner image is conveyed again to the fixing portion 904 to fix the toner image. Thereafter, the sheet is discharged from the upper sheet discharge roller pair 907 and conveyed to the finisher 100.

The finisher 100 sequentially receives the sheet discharged from the copier body 602, and performs a process of aligning a plurality of received sheets together and a punching process of forming a hole in the vicinity of the trailing end of the received sheet. In addition, the finisher 100 performs a stapling process (a binding process) of stapling the trailing end side of a sheet bundle, and a bookbinding process. As a sheet processing portion used to process the sheet, the finisher 100 is provided with a staple portion 100A which is a binding unit for stapling the sheet, and a saddle unit 135 which folds and bookbinds the sheet bundle. The finisher 100 is provided with a sheet discharge apparatus 100D which includes a sheet stacking apparatus 100C. The sheet stacking apparatus 100C is provided with a bundle discharge roller pair (described below) to discharge the sheet and the sheet bundle, and an upper tray 136 and a lower tray 137 which are sheet stacking portions used to stack the discharged sheet and the discharged sheet bundle. It is noted that the upper tray 136 and the lower tray 137 are elevated by an elevating unit 1372 illustrated in FIGS. 6A and 6B described below. That is, the elevating unit 1372 is a moving unit configured to move the sheet stacking portion in this embodiment.

Figure 2:
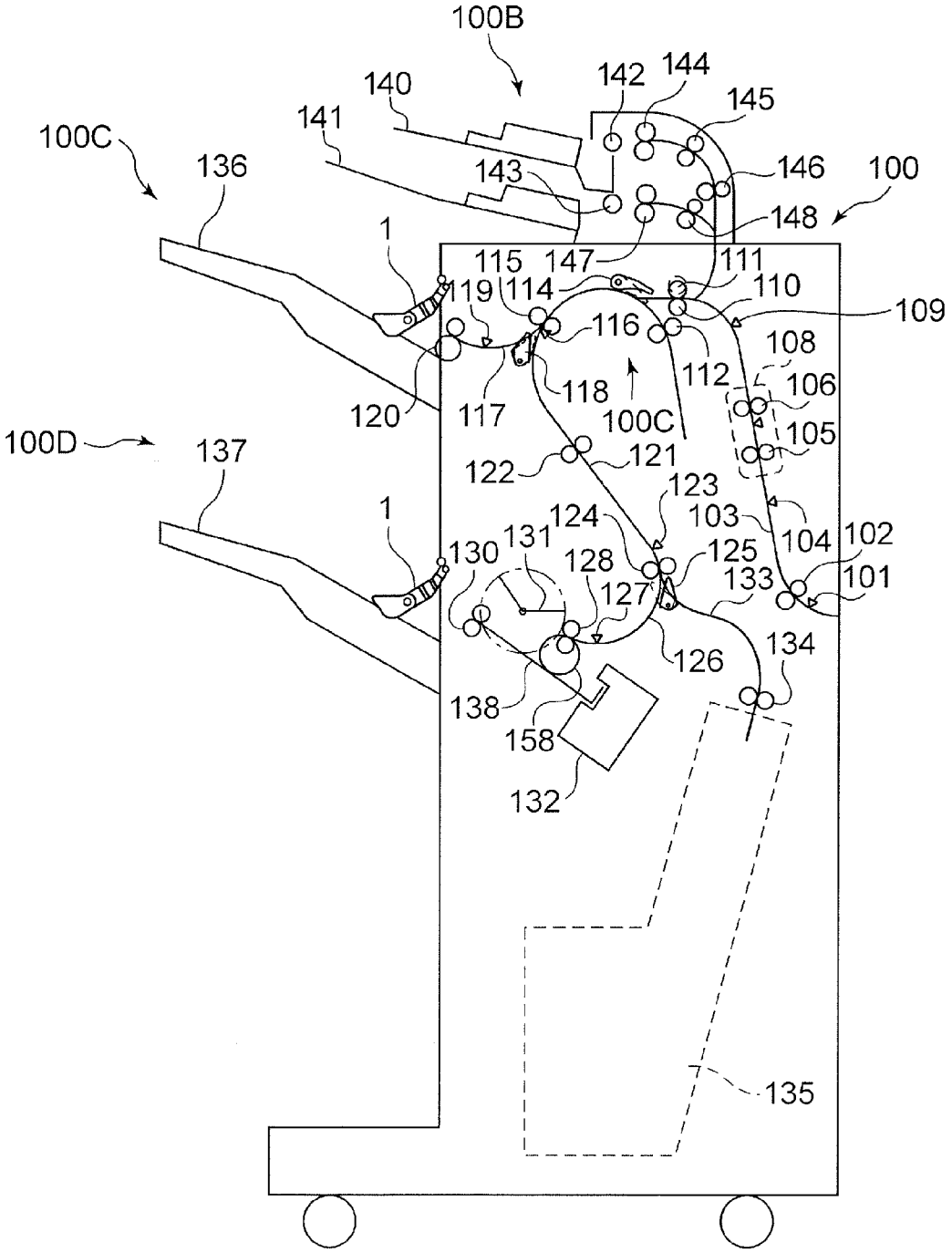
FIG. 2 is a diagram for describing a configuration of a finisher which is the sheet processing apparatus.

The finisher 100 is provided with an inlet roller pair 102 to receive the sheet into the apparatus as illustrated in FIG. 2. The sheet discharged from the copier body 602 is transferred to the inlet roller pair 102. It is noted that, at this time, a transfer timing of the sheet is simultaneously detected by an inlet port sensor S101.

Thereafter, the position of the end portion of the sheet conveyed by the inlet roller pair 102 is detected by a lateral registration detection sensor S104 while the sheet passing through a conveyance path 103. A degree of deviation in a width direction with respect to the center position of the finisher 100 is detected. In addition, after the deviation in the width direction (hereinafter, referred to as a lateral registration error) is detected, a shift unit 108 moves by a predetermined amount in a forward direction or a back direction, so that the sheet is shifted while being conveyed to a shift roller pair 105 and 106. Herein, "forward (front)" indicates a front surface side of the apparatus when the user stands toward the operating unit 601 illustrated in FIG. 1, and "back" indicates a rear surface side of the apparatus.

Next, the sheet is conveyed by a conveyance roller 110 and a separation roller 111, and reaches a buffer roller pair 115. Thereafter, in a case where the sheet is discharged to the upper tray 136, an upper path switching member 118 enters a state as depicted with a broken line in the drawing by a drive unit (not illustrated) such as a solenoid. Therefore, the sheet is guided to an upper conveyance path 117, and discharged to the upper tray 136 by an upper sheet discharge roller pair 120. In a case where the sheet is not discharged to the upper tray 136, the sheet conveyed by the buffer roller pair 115 is guided to a bundle conveyance path 121 by the upper path switching member 118 in a state as depicted with the solid line. Thereafter, the sheet sequentially passes through the conveyance path by a conveyance roller 122 and a bundle conveyance roller pair 124.

Next, in a case where the conveyed sheet is discharged to the lower tray 137 on the lower side, the sheet is conveyed to a lower path 126 by a saddle path switching member 125 in a state as depicted with the solid line. Thereafter, the sheet is sequentially conveyed to an intermediate processing tray 138 by a lower sheet discharge roller pair 128 serving as a sheet conveying portion. The conveyed sheet is aligned while being sequentially stacked by returning units such as a paddle 131 and a belt roller 158. The sheet bundle thus aligned and stacked by a predetermined number is subjected to an alignment process on the intermediate processing tray.

Next, the sheet bundle subjected to the alignment process on the intermediate processing tray is subjected to the binding process using a stapler 132 of the binding unit as needed. Thereafter, the sheet bundle is discharged to the lower tray 137 on the lower side by a bundle discharge roller pair 130 serving as a discharging portion. It is noted that the stapler 132 is movable in the width direction (hereinafter, referred to as a front-back direction) perpendicular to the direction of sheet conveyance, and can perform the binding process on the trailing end portion of the sheet bundle in several places.

On the other hand, in a case where the sheet is subjected to a saddle (saddle stitch) process, the saddle path switching member 125 is moved to a position indicated by a broken line using a drive unit (not illustrated) such as a solenoid. The sheet S is transported to the saddle path 133 to be guided to a saddle unit 135 using a pair of saddle inlet rollers 134, and performs the saddle stitch process (saddle stitch process).

It is noted that, as illustrated in FIG. 2, an inserter 100B is provided on the upper portion of the finisher 100. The inserter 100B is used to insert a sheet (an insert sheet) different from a normal sheet into the first page, the last page of the sheet bundle, or between the sheets containing an image formed by the copier body 602.

The inserter 100B conveys the insert sheet set in insert trays 140 and 141 to any of the upper tray 136, the intermediate processing tray 138, and the saddle unit 135 without passing through the copier body 602. In a case where the inserter 100B as described above inserts the insert sheet in the image-formed sheet bundle, the insert sheet set in the insert trays 140 and 141 is fed by pickup rollers 142 and 143.

Then, the insert sheet is conveyed by conveyance rollers 144, 145, 147, and 148, and joined on the upstream side of the conveyance roller 110 and the separation roller 111 of the finisher 100. Thereafter, similarly to the sheet discharged from the copier body 602, the insert sheet is conveyed to any of the upper tray 136, the intermediate processing tray 138, and the saddle unit 135.

In addition, as illustrated in FIG. 2, a width direction arranging member 1 is provided on the upper side of the upper tray 136 and the lower tray 137. The width direction arranging member 1 is used to align the position of the sheet stacked on the upper tray 136 and the lower tray 137 in the width direction perpendicular to a sheet discharge direction. When the sheet is discharged to the upper tray 136 and the lower tray 137, the width direction arranging member 1 descends toward the side in the width direction of the sheet stacked on the upper tray 136 and the lower tray 137. Thereafter, the width direction aligning member moves in the width direction and aligns the position of the sheet in the width direction.

Figure 3:
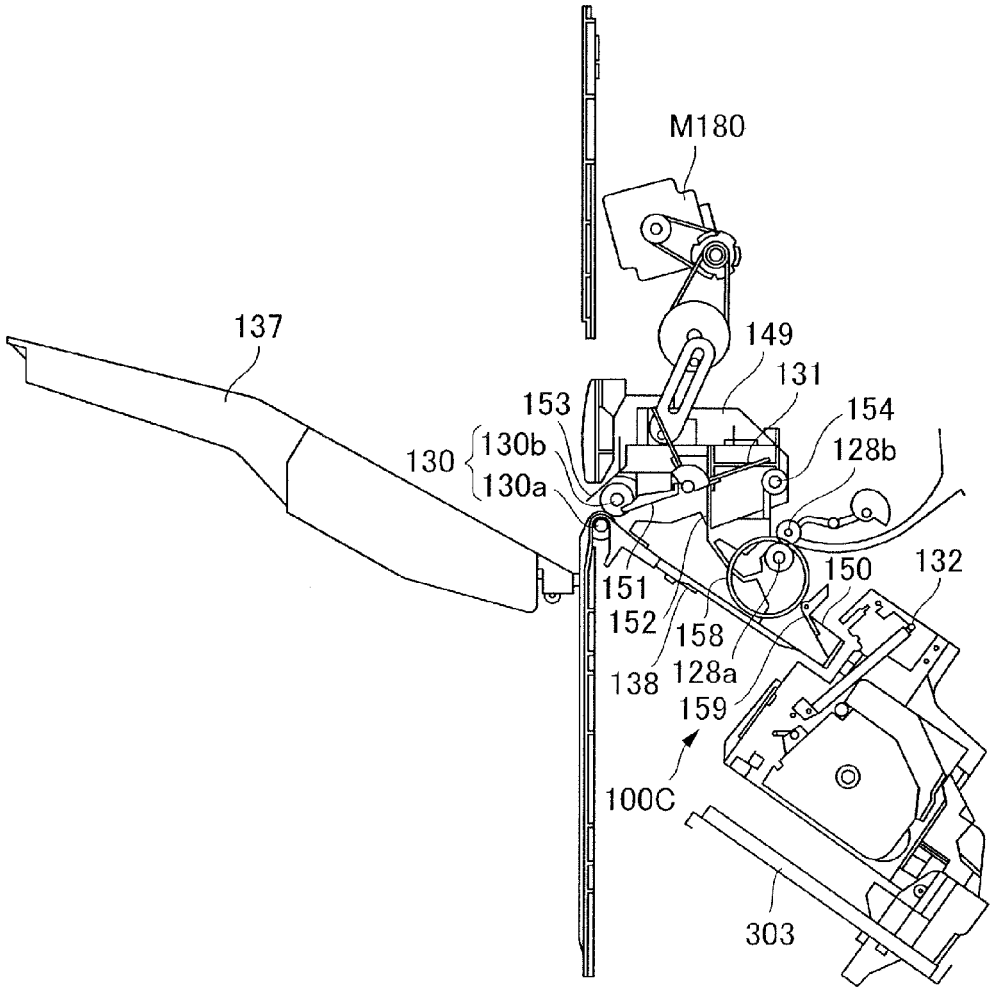
FIG. 3 is a diagram for describing configurations of an intermediate processing tray and a staple portion provided in the finisher.

Next, the description will be made about the configuration of the intermediate processing tray 138 and the staple portion 100A. As illustrated in FIG. 3, the intermediate processing tray 138 is inclined upward along the direction of conveyance of the sheet bundle so that the downstream side (the left side of FIG. 3) in the direction of conveyance of the sheet bundle is higher than the upstream side (the right side of FIG. 3). A trailing end stopper 150 is disposed in the end portion on the lower side (the upstream side) of the intermediate processing tray 138. It is noted that the intermediate processing tray 138 may be provided in the horizontal direction.

Figure 4:
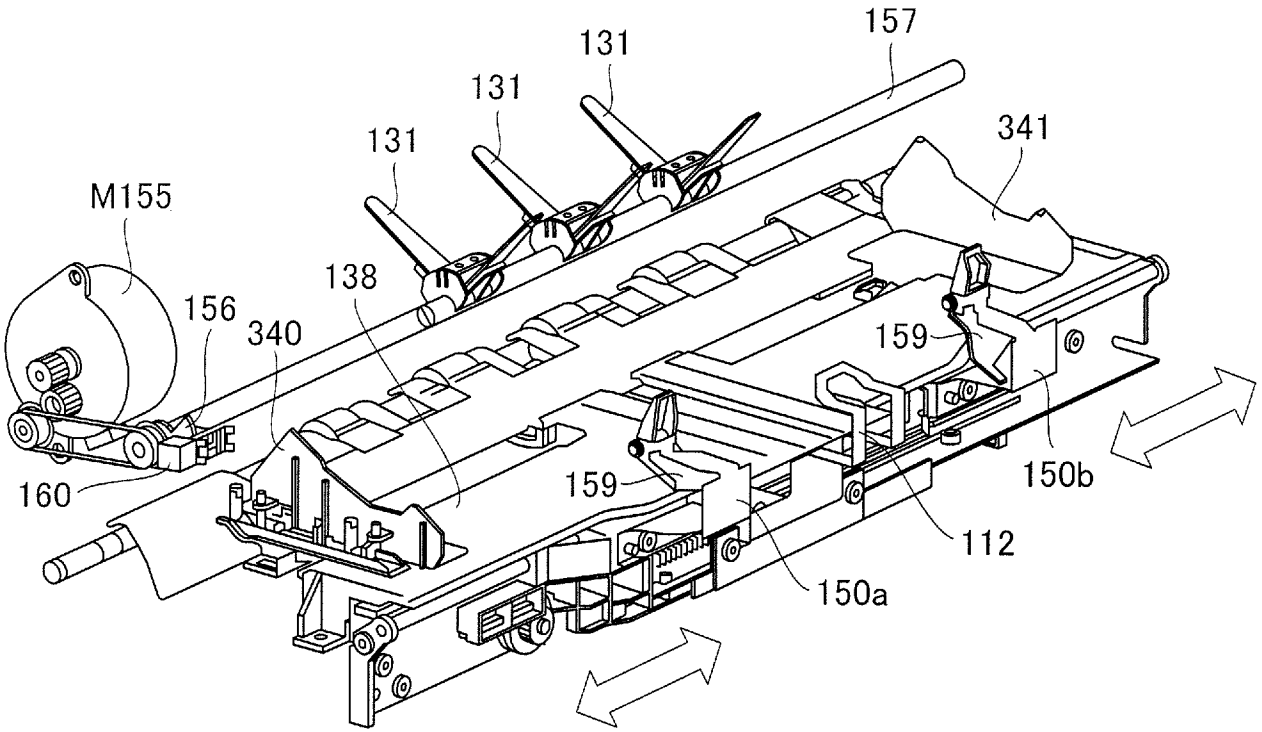
FIG. 4 is a diagram for describing a take-in paddle and a trailing end stopper which are provided in the intermediate processing tray.

In an intermediate portion of the intermediate processing tray 138, as illustrated in FIG. 4, front and back aligning panels 340 and 341 are provided movably along the width direction to regulate positions of the both side ends in the width direction of the sheet conveyed to the intermediate processing tray 138. The front and back aligning panels 340 and 341 can be exclusively driven by an aligning panel motor (not illustrated). When regulating the positions of the both side ends of the sheet, the front and back aligning panels 340 and 341 are moved to align the positions of the both side ends of the sheet stacked on the intermediate processing tray 138.

In addition, as illustrated in FIG. 4, a take-in paddle 131 and a swing guide 149 illustrated in FIG. 3 are disposed in an end portion on the upper side (the downstream side in a take-in direction) of the intermediate processing tray 138. The take-in paddle 131 is provided on the upper side of the intermediate processing tray 138. A plurality of take-in paddles are fixed along a drive shaft 157 which is rotated by a paddle drive motor M155. The take-in paddle 131 is rotated in a counterclockwise direction at an appropriate timing by the paddle drive motor M155.

In the upper side of the intermediate processing tray 138, as illustrated in FIG. 3, the belt roller 158 (an endless belt) is provided rotatably in the counterclockwise direction. The belt roller 158 is wound on the outer periphery of a first conveyance roller 128*a* of the lower sheet discharge roller pair 128 (see FIG. 2) in a positional relation such that the lower portion of the belt roller abuts on the uppermost one among the sheets stacked on the intermediate processing tray 138. Then, when the belt roller is rotated in the counterclockwise direction following the rotation of the first conveyance roller 128*a*, the sheet conveyed onto the intermediate processing tray 138 is conveyed in the opposite direction to the direction of conveyance so as to abut on the trailing end stopper 150.

In addition, the swing guide 149 is provided in the upper side of the intermediate processing tray 138 to be rotatably in the vertical direction. The swing guide 149 rotatably holds an upper discharging roller 130*b* which forms the bundle discharge roller pair 130 together with a lower discharging roller 130*a* provided in the end portion on the downstream side of the intermediate processing tray 138. As the swing guide 149 is swung, the upper discharging roller 130*b* abuts or moves away with respect to the lower discharging roller 130*a*.

The swing guide 149 is swung in the vertical direction about a supporting shaft 154 by a drive from a swing guide opening/closing motor M180. In general, when the sheet is conveyed onto the intermediate processing tray 138, the swing guide is swung to the upper side, and accordingly the upper discharging roller 130*b* is separated from the lower discharging roller 130*a* so as to enter an opening state. In addition, when the processing of the sheet on the intermediate processing tray 138 is ended, the swing guide 149 is swung to the lower side to nip the sheet bundle using the upper discharging roller 130*b* and the lower discharging roller 130*a*. In this way, when the bundle discharge roller pair 130 is rotated in the state where the sheet bundle is nipped by the upper discharging roller 130*b* and the lower discharging roller 130*a*, the sheet bundle is conveyed to the lower tray 137. It is noted that, for example, the lower discharging roller 130*a* of the bundle discharge roller pair 130 is rotated forwardly or reversely by a discharge motor M10 illustrated in FIG. 10 described below.

In the swing guide 149, there is provided a guide 151 which is positioned in a portion on the upstream side of the upper discharging roller 130*b* to guide the sheet to a roller nip portion of the upper discharging roller 130*b*. In addition, in the swing guide 149, there is provided a first neutralization needle 152 which is disposed along an axial direction to remove the surface charges of the sheet when the sheet is discharged from the lower sheet discharge roller pair 128 into the intermediate processing tray 138. Furthermore, in the swing guide 149, there is provided a second neutralization needle 153 which is disposed along an axial direction at a position in a portion on the downstream side of the upper discharging roller 130*b* to remove the surface charges of the sheet conveyed by the bundle discharge roller pair 130.

Figure 5A:
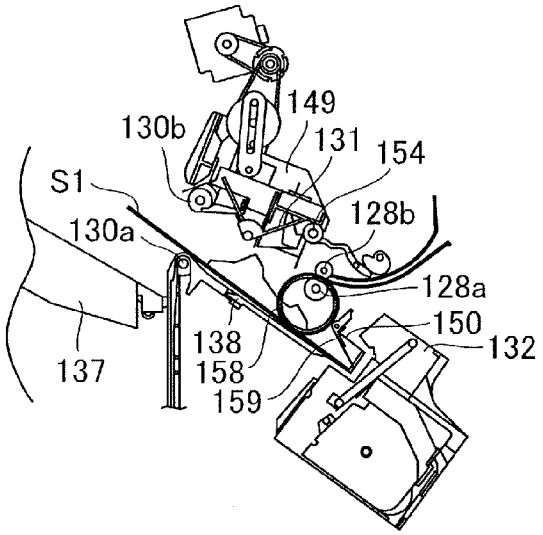
FIG. 5A is a diagram for describing an aligning operation in a direction of conveyance of a sheet which is conveyed to the intermediate processing tray.

Next, the description will be made about an operation from the conveyance to the alignment of the sheet at the time of a staple mode of the finisher 100 configured as above. For example, when a job of the staple is selected in the operating unit 601, a staple job starts. A sheet S1 discharged from the copier body 602 starts to be conveyed to the intermediate processing tray 138. Then, as illustrated in FIG. 5A, when the trailing end of the sheet S1 is released from the nip of the lower sheet discharge roller pair 128 and the sheet S1 is conveyed up to the intermediate processing tray 138, a finisher control unit 636 causes the take-in paddle 131 to be rotated in the counterclockwise direction.

Therefore, the conveyed sheet S1 slides on the stack surface of the intermediate processing tray 138 or on the sheet stacked on the intermediate processing tray 138 by the inclination of the intermediate processing tray 138 and the operation of the take-in paddle 131. The slid sheet S1 moves along with the rotation of the belt roller 158 in the counterclockwise direction while being guided by a trailing end lever 159. Then, the slid sheet abuts on the trailing end stopper 150 of which the trailing end (the end on the upstream side in the direction of conveyance) serves as a stopper and is stopped. Therefore, the position in the direction of conveyance of the sheet S1 is aligned.

Figure 5B:
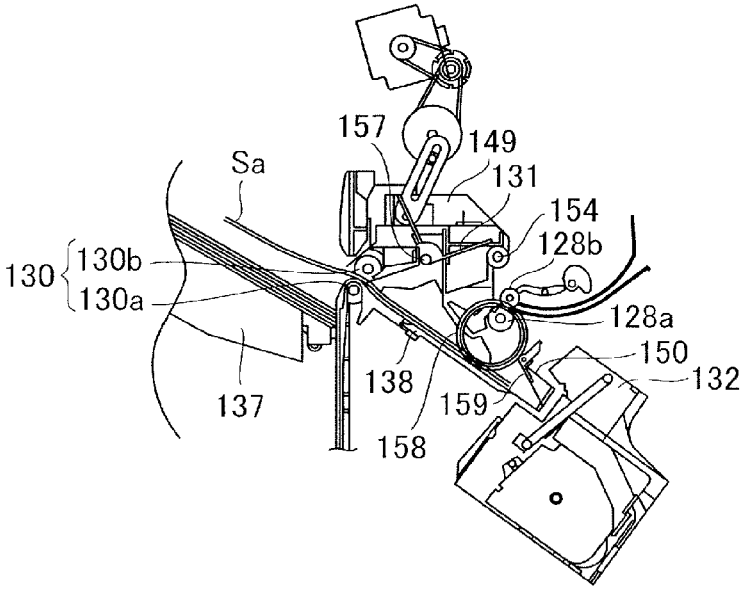
FIG. 5B is a diagram for describing an operation of discharging a sheet bundle subjected to a binding process.

Next, when the alignment of the sheet S1 (the trailing end) in the direction of conveyance is ended, the front aligning panel 340 and the back aligning panel 341 are driven, and the sheet is shifted and aligned in the width direction. Such a series of shifting and aligning operations are repeatedly performed on the next conveying sheet until the final sheet (the final conveying sheet in the bundle) of the staple bundle is conveyed from the lower sheet discharge roller pair 128. Thereafter, the binding process is performed on the conveyed sheet by the stapler 132. Thereafter, as illustrated in FIG. 5B, the swing guide 149 descends to nip a sheet bundle Sa by the upper discharging roller 130*b* and the lower discharging roller 130*a*, and the sheet bundle is conveyed to the lower tray by the bundle discharge roller pair 130 and a trailing end assist 112 illustrated in FIG. 4 already described above. This operation is repeatedly performed on a designated number of bundles. In this embodiment, the upper tray 136 and the lower tray 137 are configured to be elevatable. When the sheet bundle Sa is discharged, the upper tray 136 and the lower tray 137 descend in order to prevent that the stacked sheet bundle does not hinder the discharging of the next sheet bundle.

Figure 6A:
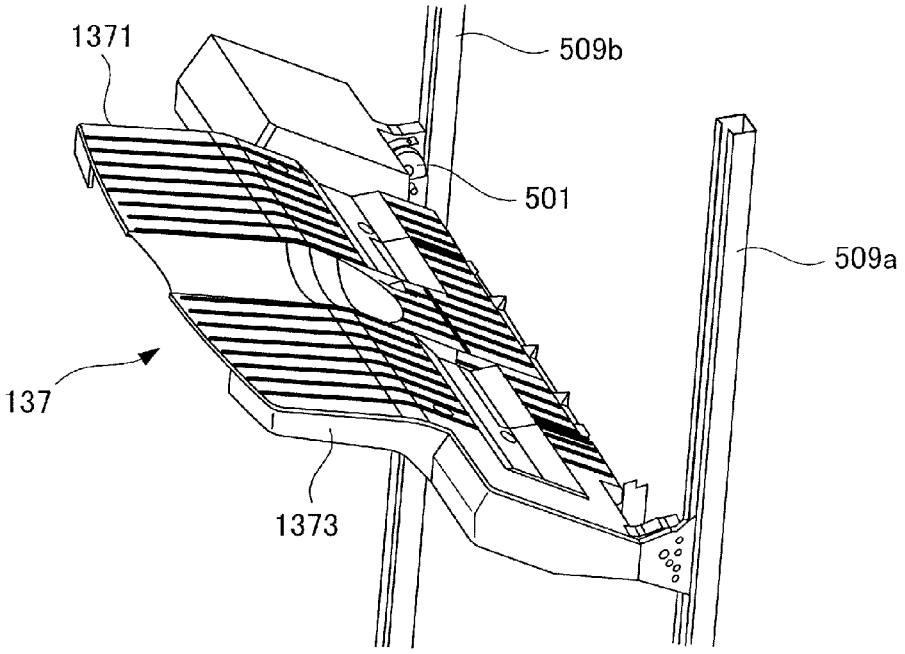
FIG. 6A is a perspective view of a lower tray which is provided in the finisher.
Figure 6B:
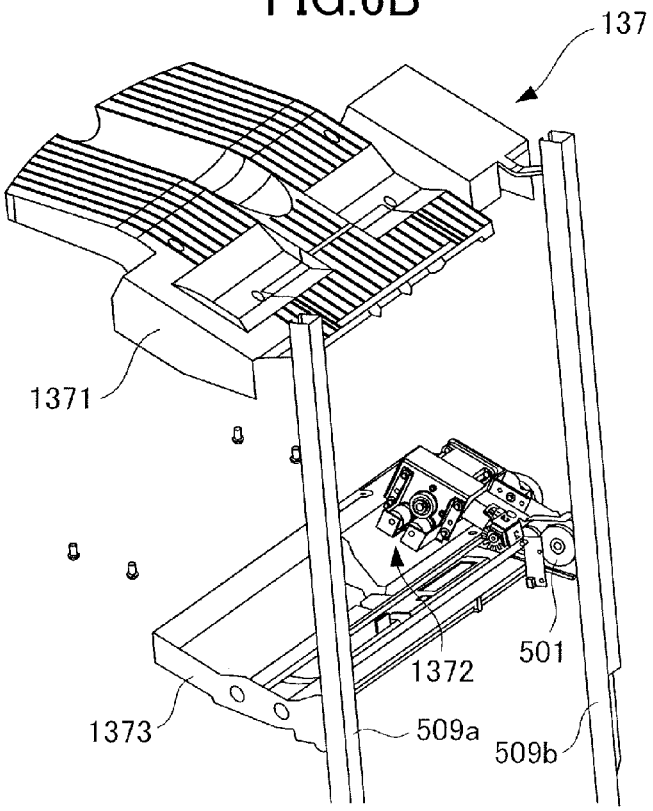
FIG. 6B is a perspective view for describing a configuration of the lower tray.

Next, the lower tray 137 will be described using FIGS. 6A and 6B. It is noted that the upper tray 136 also has the same configuration. The lower tray 137 is elevated along a pair of racks 509*a* and 509*b* which are provided in a finisher body 400 to be extended in the vertical direction as illustrated in FIG. 6A. In addition, the lower tray 137 is provided with, as illustrated in FIG. 6B, a stacking portion 1371 on which the sheet is stacked, and a main body portion 1373 in which the elevating unit 1372, which includes a pinion gear 501 engaged with the racks 509*a* and 509*b*, is disposed.

Figure 7A:
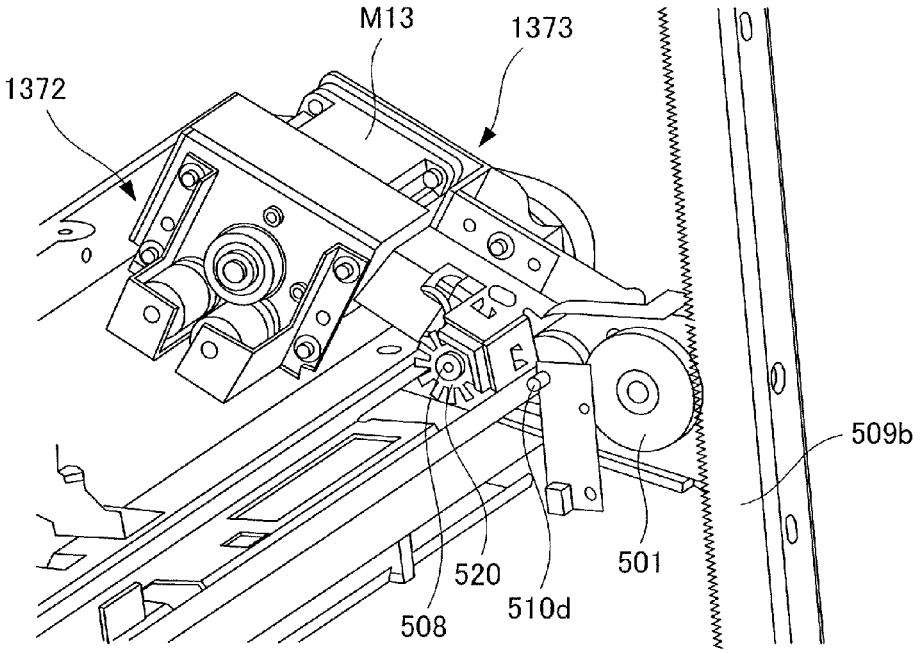
FIG. 7A is a first diagram for describing a configuration of an elevating unit of the lower tray.
Figure 7B:
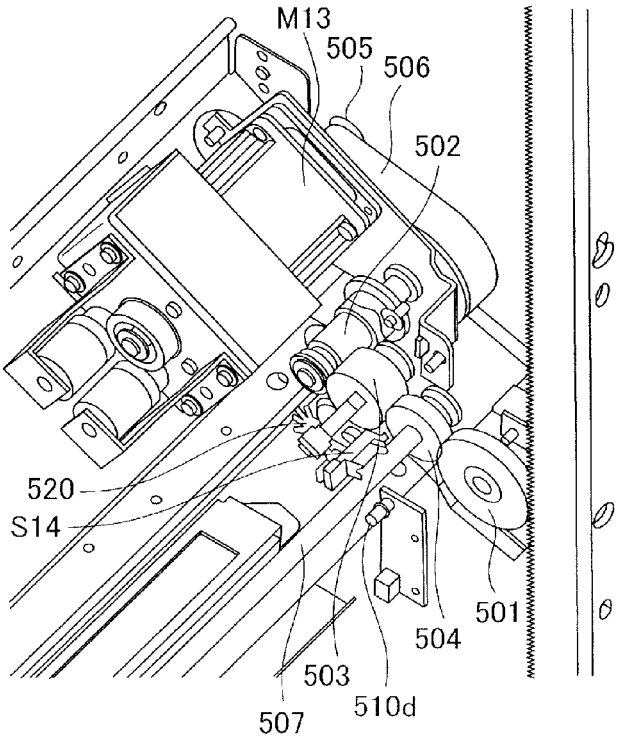
FIG. 7B is a second diagram for describing a configuration of the elevating unit of the lower tray.

Herein, the elevating unit 1372 is provided with a tray elevating motor M13 as illustrated in FIGS. 7A and 7B. A driving force of the tray elevating motor M13 is transferred to the pinion gear 501 through an elevating belt 506, an elevating pulley 505, and a first elevating gear 502, a second elevating gear 503, and a third elevating gear 504, which are rotated by the elevating pulley 505. It is noted that the pinion gear 501 is fixed to one end of an elevating shaft 507, and in the other end of the elevating shaft 507, there is provided a pinion gear (not illustrated) which is engaged with the rack 509*a*. With this configuration, when the pinion gear 501 is rotated by the tray elevating motor M13, the pinion gear (not illustrated) is also rotated in synchronization with the pinion gear 501. The lower tray 137 is elevated by the rotation of the two pinion gears 501.

Figure 8:
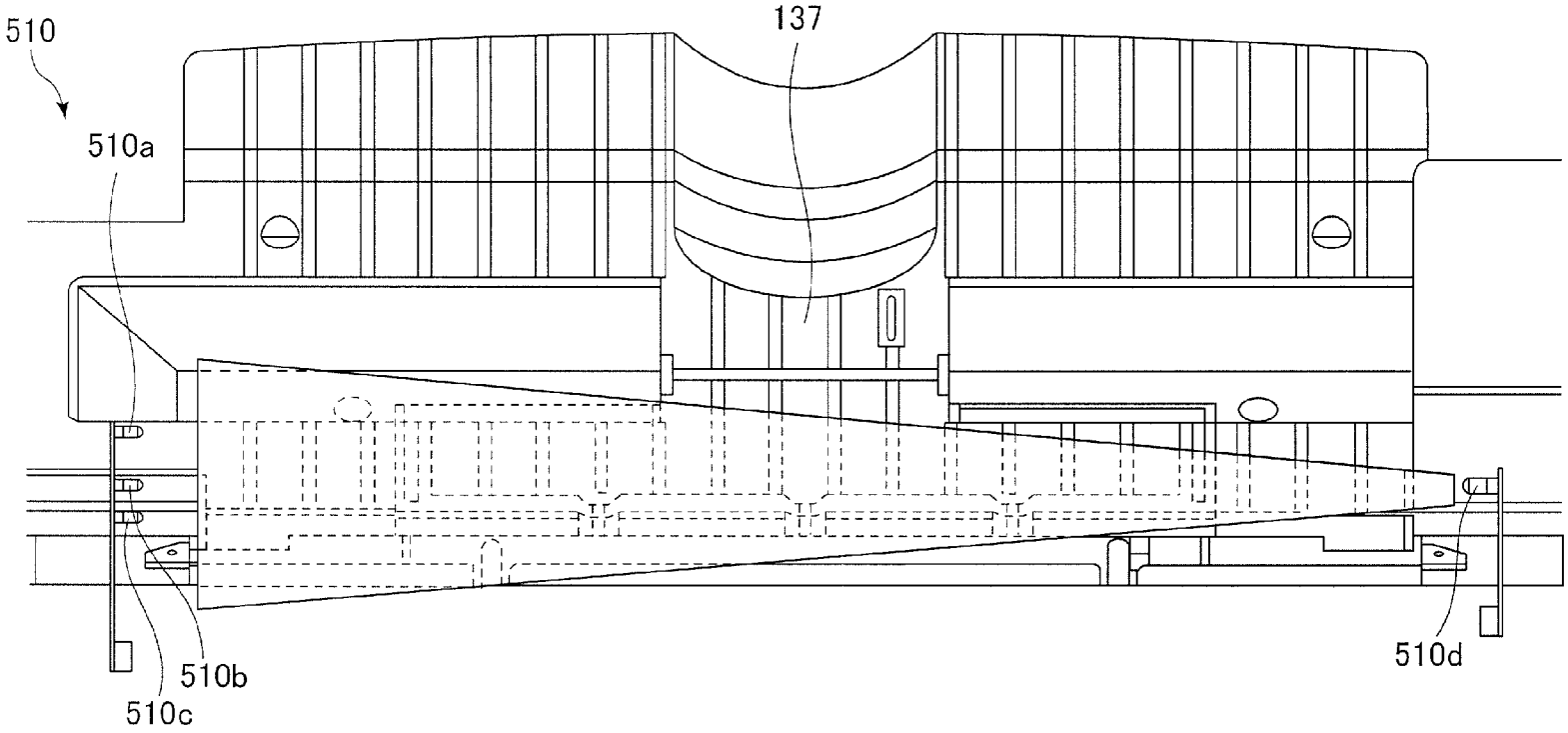
FIG. 8 is a diagram for describing a configuration of a sheet height detecting portion which is provided in the sheet discharge apparatus.

In this embodiment, the sheet discharge apparatus 100D is provided with a sheet height detecting portion 510 which is used to detect the sheet stack surface in the upper and lower trays 136 and 137 and a height position of the uppermost surface of the sheet bundle by using optical sensors. The sheet height detecting portion 510 is provided with, as illustrated in FIG. 8, a first detecting portion 510*a*, a second detecting portion 510*b*, a third detecting portion 510*c* which are disposed in the vertical direction, and a light-emitting member 510*f* which emits the light toward the respective detecting portions 510*a* to 510*c*. In this embodiment, the first detecting portion 510*a* is located at the highest position, and the third detecting portion 510*c* is located at the lowest position.

The second detecting portion 510*b* is used to detect whether the height position of the sheet stack surface in the lower tray 137 or the height position of the uppermost surface of the sheet bundle on the lower tray when the discharging operation of the sheet bundle starts is an initial height position (a first height position) where the sheet bundle becomes dischargeable. In addition, the third detecting portion 510*c* is positioned below the second detecting portion 510*b*, and used to detect whether the height position of the uppermost surface of the sheet bundle becomes lower than a predetermined height position (a second height position) lower than the initial height position.

Then, the first detecting portion 510*a*, the second detecting portion 510*b* (a first sheet detection portion), and the third detecting portion 510*c* (a second sheet detection portion) are turned on and off according to whether the light is received from the light-emitting member 510*f*. Herein, in a case where the sheet is not stacked on the lower tray before the job starts, the height position of the sheet stack surface in the lower tray 137 is the initial height position. In this case, only the third detecting portion 510*c* at the lowest position is blocked from the light by the lower tray 137 and thus turned on.

In addition, the sheet bundle on the lower tray 137 may be removed in a state where the sheet bundle is stacked to cause the lower tray 137 to descend. In this case, when the height position of the uppermost surface of the sheet bundle becomes lower than a predetermined height position, the third detecting portion 510*c* is turned off. In other words, the finisher control unit 636 recognizes whether the sheet stacked on the lower tray 137 is removed based on a signal from the third detecting portion 510*c*. In a case where the third detecting portion 510*c* is turned off, the tray elevating motor M13 is driven. After the third detecting portion 510*c* is turned on, the lower tray 137 is raised up to a position until the second detecting portion 510*b* is turned on. Thereafter, the lower tray 137 descends to a position where the second detecting portion 510*b* is turned off. Therefore, the height position of the sheet stack surface of the lower tray 137 in a state where the sheet bundle is removed becomes the initial height. It is noted that as an interval between the second detecting portion 510*b* and the third detecting portion 510*c* in the vertical direction is narrow, the lower tray 137 can be raised even in a case where the number of sheet bundles to be removed is less. The finisher control unit 636 which receives signals from the third detecting portion 510*c* and the third detecting portion 510*c* are configured as a recognition portion which recognizes whether the sheet stacked on the lower tray 137 is removed.

In a case where the sheet bundle is stacked on the lower tray 137 at the time of the job start, the first detecting portion 510*a* and the second detecting portion 510*b* are blocked from the light due to the stacked sheet bundle and thus turned on. In this case, the tray elevating motor M13 is driven reversely to cause the lower tray 137 to descend until the second detecting portion 510*b* is turned off. Therefore, the height position (hereinafter, referred to as a height position of an uppermost surface) of the sheet bundle stacked on the lower tray 137 becomes the initial height (a first height).

Thereafter, when the job starts and the sheet bundle stacks sequentially, the second detecting portion 510*b* is blocked from the light by the sheet bundle and turned on. Thereafter, when the first detecting portion 510*a* is turned on by the stacked sheet bundle, the tray elevating motor M13 is rotated reversely. The lower tray 137 descends until the second detecting portion 510*b* is turned off. Therefore, the height position of the uppermost surface of the lower tray 137 becomes the initial height. Thereafter, when the sheet bundle is stacked furthermore and the first detecting portion 510*a* is turned on, the lower tray 137 descends. Repeating this operation, the sheet bundle is sequentially stacked onto the lower tray 137. It is noted that when the second detecting portion 510*b* is turned on, the lower tray 137 may descend until the second detecting portion 510*b* is turned off without waiting for the first detecting portion 510*a* to be turned on.

It is noted that, as illustrated in FIG. 7A already described above, the main body portion 1373 is provided with an encoder shaft 508 which is rotated in association with the rotation of the first elevating gear 502, and that the encoder shaft 508 is provided with an encoder 520 attached thereto. In addition, as illustrated in FIG. 7B, the main body portion 1373 is provided with a position detecting sensor S14 which detects a rotation of the encoder 520. Then, a reverse rotation amount of the tray elevating motor M13 (that is, a descending amount of the lower tray 137) is detected by detecting the rotation of the encoder 520 using the position detecting sensor S14. The descending amount from the position at the time when the lower tray 137 starts the job is detected. A tray positioning control before the job, a control of slowly lowering the lower tray 137 during the job, a descending amount detection control of the lower tray 137 are similarly performed even on the upper tray 136. It is noted that, in this embodiment, the optical sensor has been used as the sheet height detecting portion 510, but that a flag type of sensor may be used.

Figure 9:
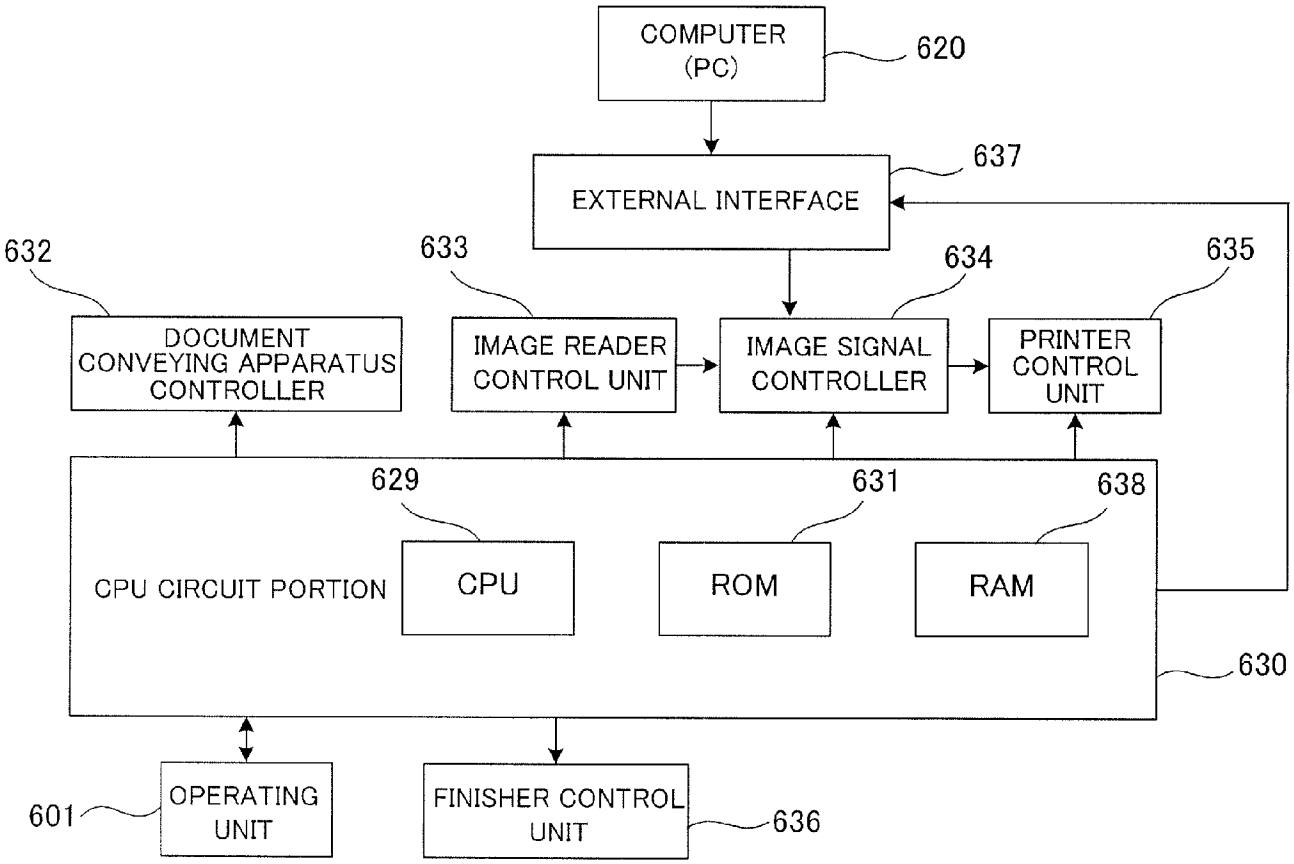
FIG. 9 is a control block diagram of the color copier.

FIG. 9 is a control block diagram of the color copier 600. The CPU circuit portion 630 includes a CPU 629, a ROM 631 which stores a control program, and a RAM 638 which is used as an area for temporally storing control data and as a work area for calculation according to the control. In addition, in FIG. 9, there is provided an external interface 637 which is used between the color copier 600 and an external computer (PC) 620. When receiving print data from the external computer 620, the external interface 637 develops the data into a bit map image, and outputs the bit map image as image data to an image signal controller 634.

Then, the image signal controller 634 outputs the data to a printer control unit 635. The printer control unit 635 outputs the data from the image signal controller 634 to an exposing control portion (not illustrated). It is noted that an image read out of a document using the image sensor 650*a* (see FIG. 1) is output from an image reader control unit 633 to the image signal controller 634. The image signal controller 634 outputs the output image to the printer control unit 635.

In addition, the operating unit 601 includes a display portion which displays a setting state and a plurality of keys for setting various functions relating to image formation. Then, the operating unit outputs a key signal corresponding to a user's operation on each key to the CPU circuit portion 630, and displays the corresponding information in the display portion based on the signal from the CPU circuit portion 630.

The CPU circuit portion 630 controls the image signal controller 634 according to a control program stored in the ROM 631 and the setting of the operating unit 601, and also controls the document conveying apparatus 651 through a document conveying apparatus controller 632 (see FIG. 1). In addition, the document reading unit 650 is controlled through the image reader control unit 633 (see FIG. 1), the image forming portion 603 is controlled through the printer control unit 635 (see FIG. 1), and the finisher 100 is controlled through the finisher control unit 636.

It is noted that, in this embodiment, the finisher control unit 636 (the control portion) is mounted in the finisher 100, and performs a drive control on the finisher 100 by exchanging information with respect to the CPU circuit portion 630. In addition, the finisher control unit 636 may be provided in the copier body integrally with the CPU circuit portion 630 in order to directly control the finisher 100 from the copier body.

Figure 10:
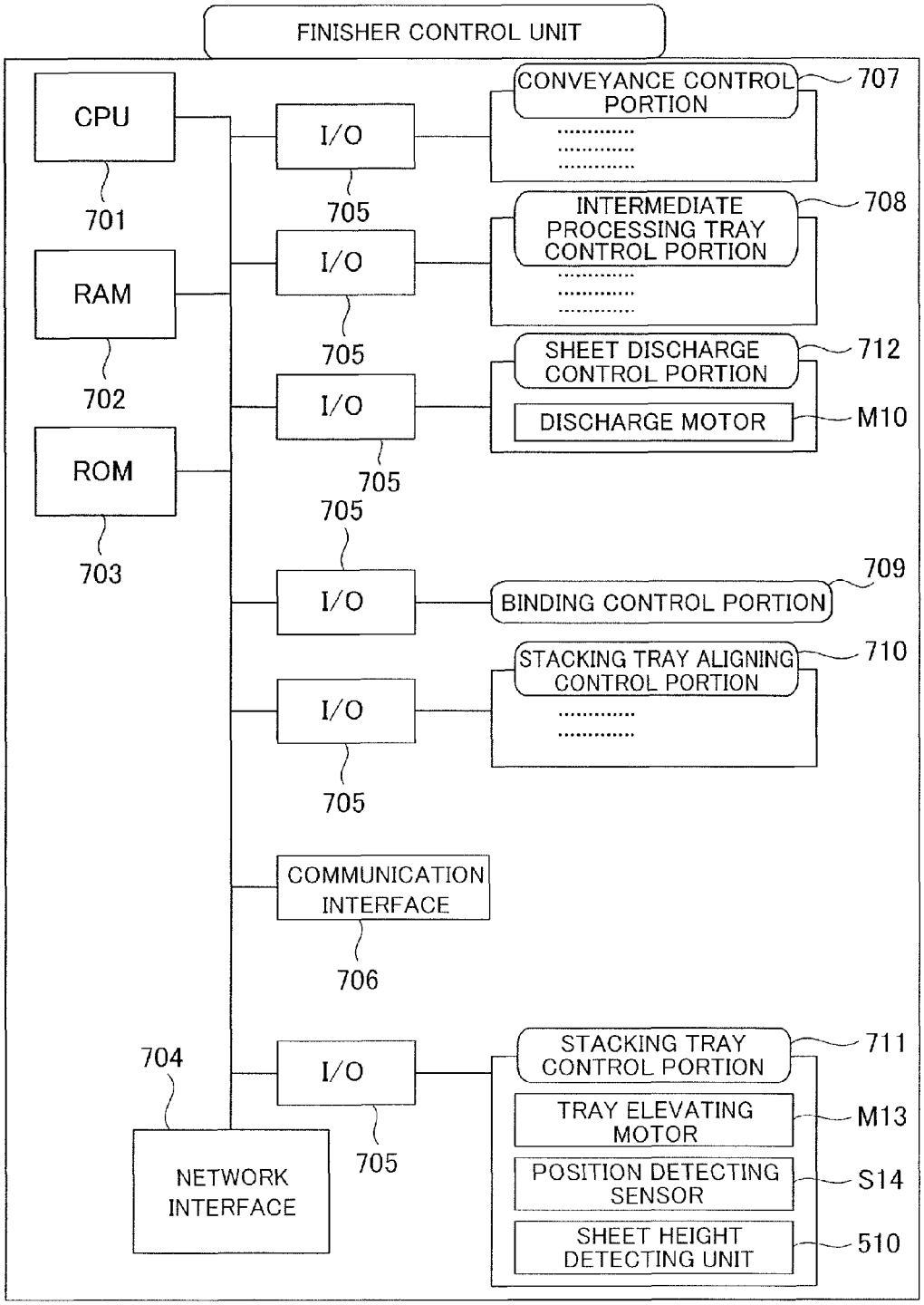
FIG. 10 is a control block diagram of the finisher.

FIG. 10 is a control block diagram of the finisher 100 according to this embodiment. The finisher control unit 636 is configured by a CPU (microcomputer) 701, a RAM 702, a ROM 703, an input/output unit (I/O) 705, a communication interface 706, and a network interface 704. In addition, the input/output unit (I/O) 705 is connected to a conveyance control portion 707, an intermediate processing tray control portion 708, a binding control portion 709, a stacking tray arranging control portion 710, a stacking tray control portion 711, and a sheet discharge control portion 712.

The conveyance control portion 707 is used to control a lateral registration detecting process, a sheet buffering process, and a conveyance process of the sheet. The intermediate processing tray control portion 708 pertains a drive control of the paddle 131 and the upper sheet discharge roller pair 120. In addition, the binding control portion 709 performs a drive control of the stapler 132. The stacking tray arranging control portion 710 performs a drive control of the width direction arranging member 1. The stacking tray control portion 711 is connected to the sheet height detecting portion 510, the position detecting sensor S14, and the tray elevating motor M13. The stacking tray control portion 711 controls the tray elevating motor M13 based on a signal from the position detecting sensor S14.

The sheet discharge control portion 712 controls the discharge motor M10, and controls a sheet discharge speed of the bundle discharge roller pair 130. In this embodiment, the sheet bundle is generally conveyed (discharged) at 400 mm/s to the lower tray 137 by the bundle discharge roller pair 130. In addition, as described below, in a case where a large quantity of sheet bundles are removed from the lower tray 137 during the sheet discharge operation so that the height position of the uppermost surface becomes lower than a predetermined height, i.e., the height position of the uppermost surface is below a predetermined height, the sheet bundle is discharged at 550 mm/s faster than 400 mm/s.

Figure 11A:
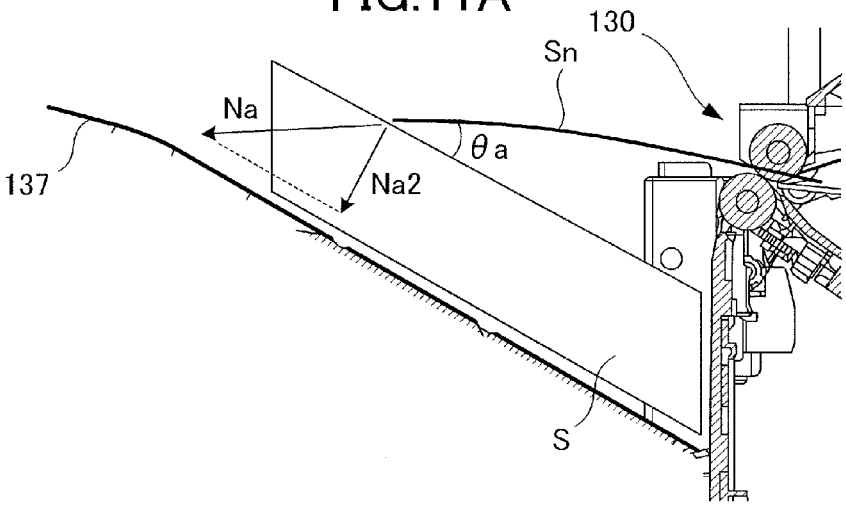
FIG. 11A is a diagram for describing an abutting state between the sheet bundle and a stacked bundle in a case where the sheet bundle of the sheet discharge apparatus is not removed.
Figure 11B:
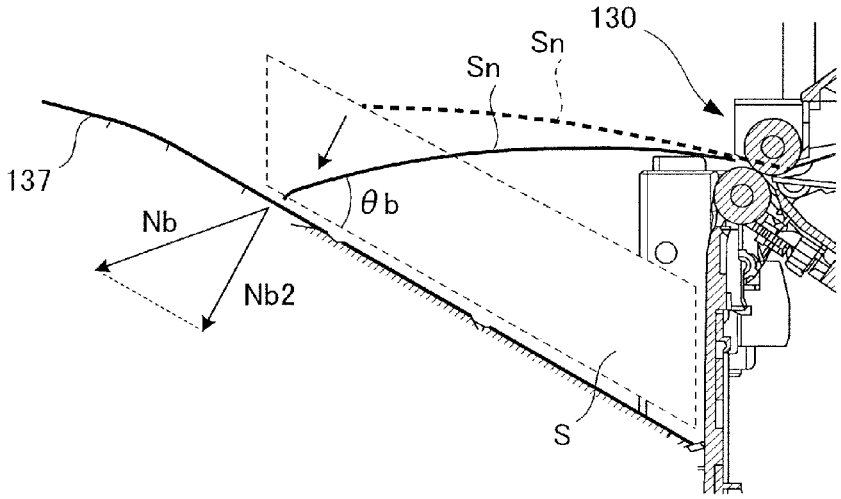
FIG. 11B is a diagram for describing an abutting state between the sheet bundle and a stacked bundle in a case where the sheet bundle of the sheet discharge apparatus is removed.

In a case where the sheet bundle is not removed, a sheet bundle Sn abuts on a stacked bundle S at an abutting angle θa as illustrated in FIG. 11A. In a case where the sheet bundle is removed and thus the height position of the uppermost surface is lowered (for example, a case where all the sheet bundles are removed from the lower tray 137), the sheet bundle Sn abuts on the lower tray 137 at an abutting angle θb as illustrated in FIG. 11B. In a case where the height position of the uppermost surface is low, or a case where there is no stacked bundle in the lower tray 137, it takes a long time until the sheet bundle Sn abuts on the lower tray 137 or the stacked bundle. Accordingly, since an amount of hung-down leading end of the sheet bundle Sn caused by its own weight becomes increased, a relation between the abutting angles θa and θb becomes θb>θa. When a force generated when the sheet bundle Sn abutting on the stacked bundle S is set to Na, and a force generated when the sheet bundle Sn abuts on the lower tray 137 is set to Nb, component forces of Na and Nb in the vertical direction become Na2 and Nb2.

Figure 11C:
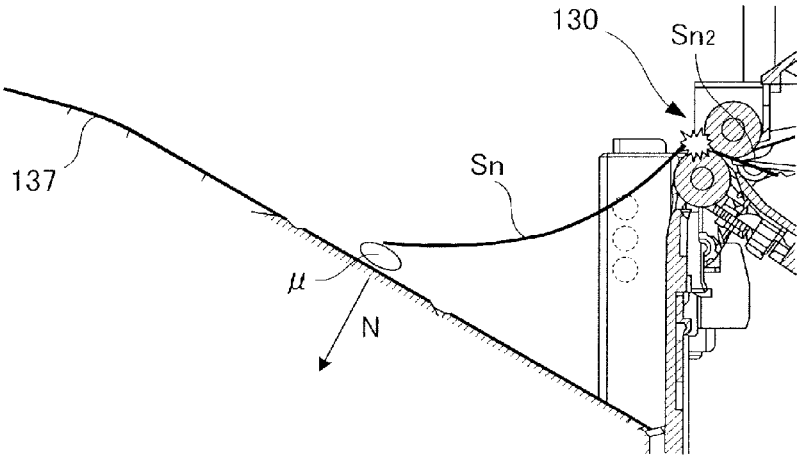
FIG. 11C is a diagram illustrating a state in which a sheet discharged from the sheet discharge apparatus is buckled and the trailing end of the sheet leans onto a bundle discharge roller.

Herein, since θb>θa is satisfied, the component force Nb2 is larger than the component force Na2. Therefore, in a case where the sheet bundle is removed and thus the lower tray has a low height position of the uppermost surface, or in a case where the sheet bundle Sn is discharged to the lower tray 137 having no stacked bundle S as illustrated in FIG. 11B, a discharge resistance μ×N of the leading end portion of the sheet bundle Sn becomes large. When the discharge resistance becomes large, the strength (stiffness) of the sheet becomes small compared to the resistance and the sheet bundle Sn may be buckled as illustrated in FIG. 11C. When the sheet bundle Sn is buckled, the trailing end of the sheet bundle leans also onto the bundle discharge roller pair 130. There occurs a defect of a stacking property or a paper jam caused by a conflict between the trailing end of the buckled sheet bundle and the next sheet bundle.

However, as already described above in this embodiment, when the sheet bundle is generally discharged at a first sheet discharge speed of 400 mm/s and it is detected that the height position of the uppermost surface becomes lower than a predetermined height, the sheet bundle is discharged at a second sheet discharge speed of 550 mm/s. In other words, when the height position of the uppermost surface is a height position under a normal tray position control, the sheet bundle is discharged at 400 mm/s. However, when the sheet bundle is removed and positioned lower than a range where the height position of the uppermost surface is controlled, the sheet bundle is discharged at 550 mm/s.

Figure 12:
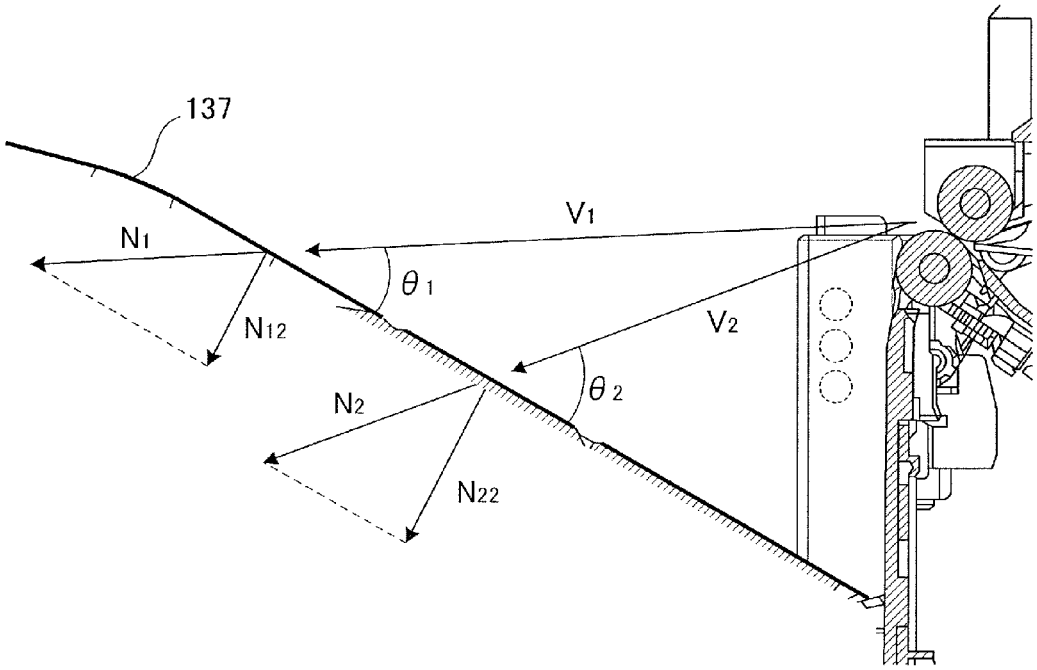
FIG. 12 is a diagram illustrating a relation of an abutting angle formed between the sheet bundle and the tray according to a sheet discharge speed in the sheet discharge apparatus.

FIG. 12 is a diagram illustrating a relation between the sheet bundle and the abutting angle of the tray according to the sheet discharge speed. It is noted that, in FIG. 12, "V1" indicates the discharge direction of the sheet when the sheet is discharged at 550 mm/s, and "V2" indicates the discharge direction of the sheet when the sheet is discharged at 400 mm/s. "θ1" indicates the abutting angle formed between the sheet bundle and the tray when the sheet bundle is discharged at 550 mm/s, and "θ2" indicates the abutting angle formed between the sheet bundle and the tray when the sheet bundle is discharged at 400 mm/s. In addition, "N1" indicates a force when the sheet bundle discharged at 550 mm/s abuts on the tray, "N2" indicates a force when the sheet bundle is discharged at 400 mm/s, and "N12" and "N22" indicate forces in the vertical direction with respect to the tray surface at that time.

As illustrated in FIG. 12, the abutting angle θ1, formed between the sheet bundle and the tray, in a case where the sheet bundle is discharged at 550 mm/s is smaller than the abutting angle θ2 in a case where the sheet bundle is discharged at 400 mm/s. In other words, when the sheet discharge speed is made fast, the abutting angle θ becomes small. It is noted that a difference between θ1 and θ2 in magnitude becomes large as the height position of the uppermost surface becomes low. In addition, at this time, the force N12 in the vertical direction with respect to the tray surface of N1 becomes smaller than the force N22 in the vertical direction with respect to the tray surface of N2. In other words, when the sheet discharge speed is set to be fast, the force in the vertical direction with respect to the tray surface can be made small. When the force in the vertical direction is set to small, the resistance in the discharge direction becomes small. Therefore, it is possible to prevent the trailing end of the sheet bundle from being hung down, and thus a defect of a stacking property and a paper jam can be prevented.

Figure 13:
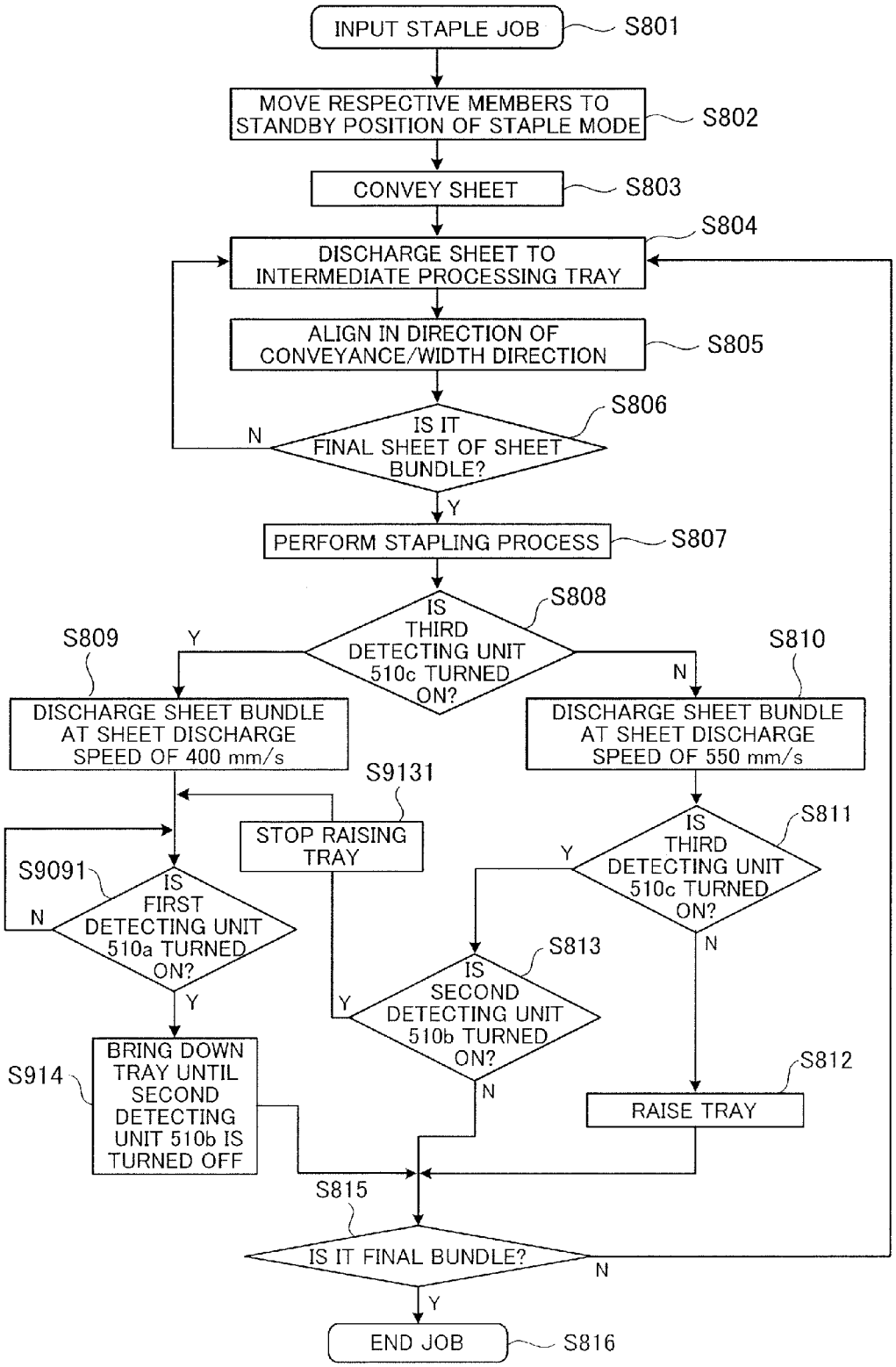
FIG. 13 is a flowchart for describing a control of the first embodiment.

Next, the description will be made using the flowchart illustrated in FIG. 13 about an operation in which the sheet bundle containing an image formed by the color copier 600 and processed by the finisher 100 is discharged by the sheet discharge apparatus 100D and stacked on the tray. It is noted that the description in this embodiment will be made about a case where the sheet bundle is discharged to the lower tray 137. However, the sheet bundle may be discharged to the upper tray 136. In addition, the following operation is controlled by the finisher control unit 636.

Figure 14A:
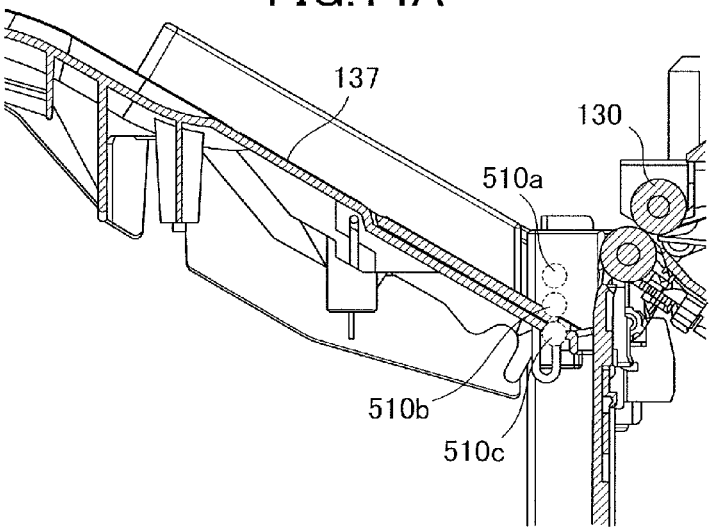
Figure 14B:
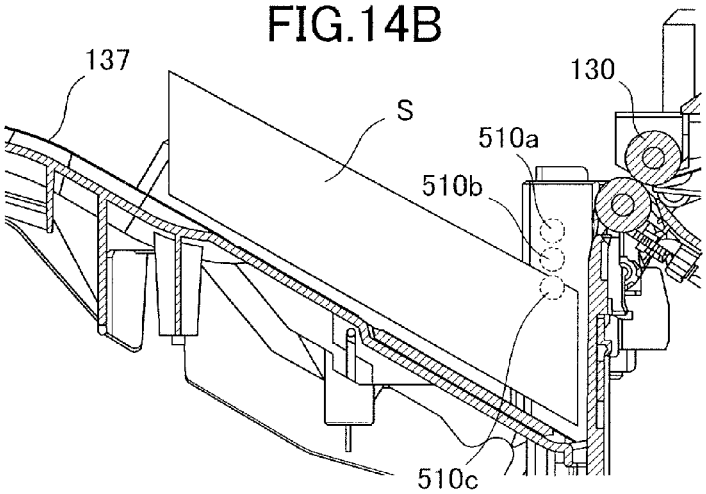

When the staple job is selected and input from the operating unit 601 of the color copier 600 (S801), the respective members are initialized and move to standby positions of the staple mode (S802). Herein, in a case where the sheet is not stacked on the lower tray 137, the lower tray 137 moves to a position where the second detecting portion is turned off and the third detecting portion is turned on as illustrated in FIG. 14A. In a case where the sheet is stacked on the lower tray 137, the lower tray 137 moves the stacked bundle S of the lower tray 137 to a position where the second detecting portion is turned off and the third detecting portion is turned on as illustrated in FIG. 14B.

Thereafter, when the sheet is conveyed from the copier body 602 (S803) and the trailing end of the sheet is released from the nip of the lower sheet discharge roller pair 128, the sheet S1 is discharged up to the intermediate processing tray 138 as illustrated in FIG. 5A already described above (S804). Thereafter, the sheet S1 abuts on the trailing end stopper 150 and aligned in the direction of conveyance by the take-in paddle 131 and the belt roller 158, and aligned in the width direction by the front aligning panel 340 and the back aligning panel 341 as illustrated in FIG. 4 already described above (S805).

Such a series of the sheet conveyance, the discharge to the intermediate processing tray, and the aligning operation is repeatedly performed until the final sheet of the sheet bundle to be stapled is discharged from the lower sheet discharge roller pair 128. Then, it is determined whether the discharged sheet is the final sheet of the sheet bundle (S806). When it is determined that the discharged sheet is the final sheet (Y in S806), the sheet bundle is subjected to the stapling process by the stapler 132 (S807). Thereafter, as illustrated in FIG. 5B already described above, the swing guide 149 descends to nip the sheet bundle S by the upper discharging roller 130*b* and the lower discharging roller 130*a*, and is discharged to the lower tray 137.

Before such a bundle discharge operation is performed, the finisher control unit 636 confirms the height position of the uppermost surface of the sheet bundle on the lower tray, and determines the sheet discharge speed according to the height position of the uppermost surface. In order to determine the sheet discharge speed as described above, the state of the third detecting portion 510*c* is confirmed (that is, whether the third detecting portion 510*c* is turned on) (S808). In the case where the third detecting portion 510*c* is turned on (Y in S808) (that is, in the case where the position of the sheet stack surface in the lower tray 137 is the same position at the time of initialization as illustrated in FIG. 14A or a case where the height position of the uppermost surface of the sheet bundle is the same position at the time of initialization as illustrated in FIG. 14B), the sheet discharge speed is set to 400 mm/s. Then, a bundle discharge is performed in which the sheet bundle is discharged at a sheet discharge speed of 400 mm/s (S809).

Next, after the bundle is discharged, the state of the first detecting portion 510*a* is confirmed (that is, whether the first detecting portion 510*a* is turned on) (S8091). In a case where the first detecting portion 510*a* is not turned on (N in S8091), the next sheet bundle is discharged. In addition, when the first detecting portion 510*a* is turned on (Y in S8091), the lower tray 137 descends until the second detecting portion 510*b* is turned off (S814). Therefore, the lower tray 137 descends to a position where the subsequent sheet bundle becomes dischargeable. Thereafter, it is confirmed whether the discharged sheet bundle is the final bundle of the job (S815). In a case where the discharged sheet bundle is not the final bundle (N in S815), the processes of S804 to S8091 and S813 to S815 already described above are repeatedly performed. Then, when the final bundle is discharged (Y in S815), the job is ended (S816).

Figure 14C:
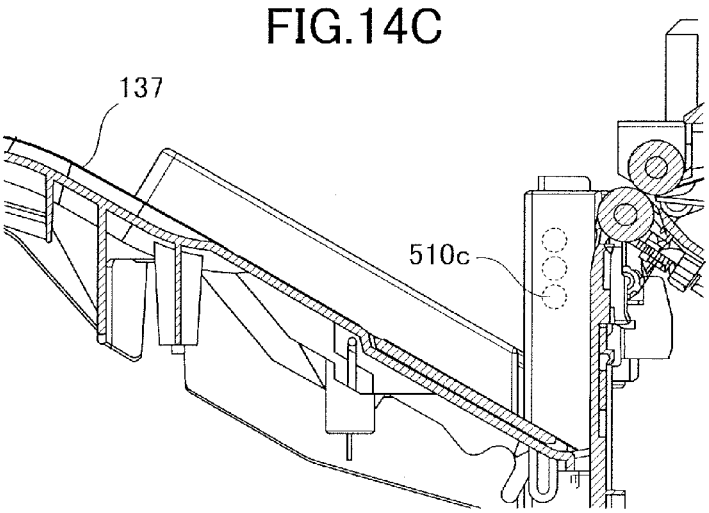

On the other hand, for example as illustrated in FIG. 14C, in a case where the sheet bundle stacked on the lower tray 137 is removed in a large quantity by the user, the third detecting portion 510*c* is turned off. In this way, in a case where the third detecting portion 510*c* is turned off (N in S808), the sheet discharge speed is determined as 550 mm/s, and the sheet bundle is discharged at a sheet discharge speed of 550 mm/s (S810).

Next, after the discharge of the sheet bundle to the lower tray 137 at a sheet discharge speed of 550 mm/s is completed, it is confirmed whether the third detecting portion 510*c* is turned on (S811). It is noted that, for example, in a case where 300 sheet bundles (each sheet bundle contains 10 sheets) are removed, a time necessary for raising the lower tray 137 up to a position where the third detecting portion 510*c* is turned on is taken about 10 seconds in a typical product. Meanwhile, a plurality of sheet bundles are discharged at 550 mm/s. In other words, in a case where the sheet bundle is removed in a large quantity, the third detecting portion 510*c* is not turned on shortly after even when the sheet bundle is discharged at 550 mm/s (N in S811). Therefore, the lower tray 137 is raised (S812).

Next, it is confirmed whether the discharged sheet bundle is the final bundle of the job (S815). In a case where the discharged sheet bundle is not the final bundle (N in S815), the processes of S804 to S808 and S810 already described above are repeatedly performed. In a case where the lower tray 137 is raised or the third detecting portion 510*c* is turned on by the discharged sheet bundle (Y in S811), the lower tray 137 is raised up to a position where the second detecting portion 510*b* is turned on. Then, it is confirmed whether the second detecting portion 510*b* is tuned on (S813).

In a case where the second detecting portion 510*b* is turned on (Y in S813), the raising of the lower tray 137 is stopped (S8131). Thereafter, it is confirmed whether the first detecting portion 510*a* is turned on (S8091). In a case where the first detecting portion 510*a* is not turned on (N in S8091), the next sheet bundle is discharged. In addition, when the first detecting portion 510*a* is turned on (Y in S8091), the lower tray 137 descends until the second detecting portion 510*b* is turned off (S814). Therefore, the height position of the uppermost surface is returned to the same initial height at the time of initialization. Thereafter, it is confirmed whether the discharged sheet bundle is the final bundle of the job (S815). In a case where the discharged sheet bundle is not the final bundle (N in S815), the processes of S804 to S8091 and S813 to S815 already described above are repeatedly performed. Then, when the final bundle is discharged (Y in S815), the job is ended (S816).

In a case where the second detecting portion 510*b* is not turned on (N in S813), it is confirmed whether the discharged sheet bundle is the final bundle of the job (S815). In a case where the discharged sheet bundle is not the final bundle (N in S815), the processes of S804 to S808, S810, S811, and S813 already described above are repeatedly performed. Then, when the final bundle is discharged (Y in S815), the job is ended (S816).

As described above, in this embodiment, in a case where the height position of the uppermost surface is at a height position in a normal control, the sheet bundle is discharged at a predetermined sheet discharge speed of 400 mm/s. In addition, in a case where the height position of the uppermost surface is at a height position lower than a predetermined position (the second height position) where the third detecting portion 510*c* is turned off, the sheet bundle is discharged at 550 mm/s. In other words, in a case where the height position of the uppermost surface of the sheet bundle stacked on the lower tray 137 is above, i.e., exceeds, a predetermined height (the second height position), the sheet discharge speed is set to the first sheet discharge speed. In the case where the height position of the uppermost surface is lower than a predetermined height, the sheet discharge speed is set to the second sheet discharge speed faster than the first sheet discharge speed. In addition, in other words, in a case where the third detecting portion 510*c* (a sheet detection portion) detects that the height position of the uppermost sheet is above the second height position lower than the first height position, the finisher control unit (the control portion) 636 controls the sheet discharge speed of a discharging portion 130 to be the first sheet discharge speed. In a case where the finisher control unit 636 detects that the height position of the uppermost sheet becomes lower than the second height position, the finisher control unit 636 controls the sheet discharge speed to be the second sheet discharge speed faster than the first sheet discharge speed. Therefore, for example, even when the sheet bundle is discharged in a state where the sheet bundle on the tray is removed by the user and thus the height position of the uppermost surface is lowered, the resistance against the sheet bundle in the discharge direction becomes small. As a result, it is possible to prevent the trailing end of the sheet bundle from being hung down, and a defect of a stacking property and a paper jam caused by the hanging-down sheet bundle can be prevented.

It is noted that a sheet discharge starting speed (the sheet discharge speed when the bundle starts to be discharged) may be set to 900 mm/s, and that the sheet discharge speed immediately before the trailing end of the sheet bundle is released from the bundle discharge roller pair 130 may be set to be switched to 400 mm/s or 550 mm/s. In this way, the time taken for the trailing end of the sheet bundle to reach the bundle discharge roller pair 130 can be shortened by setting the sheet discharge starting speed to 900 mm/s. Therefore, producibility is improved. In this case, it is desirable that a timing for switching the sheet discharge speed to 400 mm/s or 550 mm/s is set as slow as possible so that the sheet bundle can be conveyed at 900 mm/s for a long time. Therefore, it is desirable to start decelerating at a moment when the sheet discharge speed can be decelerated from 900 mm/s to 400 mm/s or 550 mm/s.

By the way, the description in this embodiment has been made about an example in which the sheet discharge speed is changed in two steps on the basis of the signal from the third detecting portion 510*c*, but this disclosure is not limited thereto. The sheet discharge speed may be changed in three or more steps by increasing the number of sheet detecting portions located below the second detecting portion 510*b*.

Figure 15:
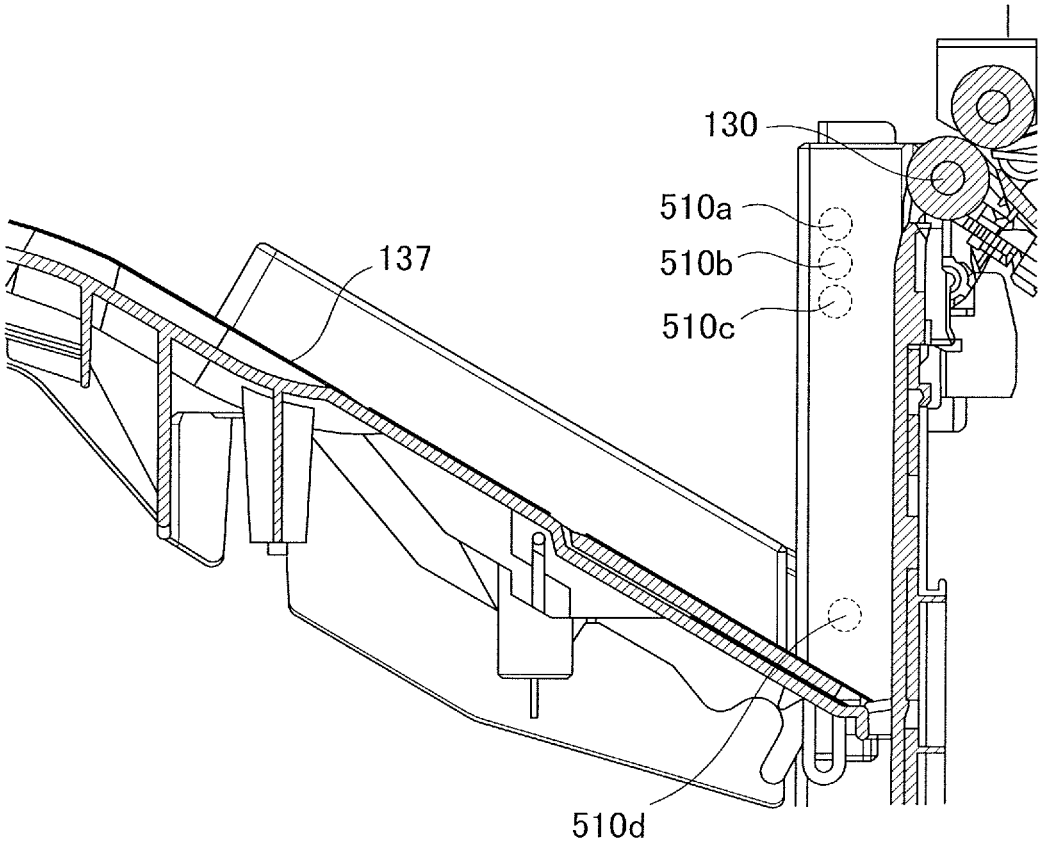
FIG. 15 is a diagram for describing a configuration of a sheet processing apparatus which is provided with a sheet discharge apparatus according to a second embodiment.

Next, the description will be made about a second embodiment of this disclosure in which the sheet discharge speed is changed in three or more steps as described above. FIG. 15 is a diagram for describing a configuration of the sheet processing apparatus which is provided with the sheet discharge apparatus according to this embodiment. It is noted that, in FIG. 15, the same symbols as those of FIGS. 14A to 14C already described above indicate the same or corresponding portions.

In this embodiment, as illustrated in FIG. 15, a fourth detecting portion 510*d* is another sheet detection portion provided below the third detecting portion 510*c*. The fourth detecting portion serves as a third sheet detection portion for detecting that the height position of the uppermost surface becomes lower than a third height position lower than the predetermined height position (the third height position). As an interval between the third detecting portion 510*c* and the fourth detecting portion 510*d* in the vertical direction is narrow, the lower tray 137 can be raised even in a case where the number of removed sheet bundles is small.

The sheet discharge speed is changed based on the turning ON/OFF of the fourth detecting portion 510*d* and the turning ON/OFF of the third detecting portion 510*c*. Specifically, in the case where the third detecting portion 510*c* is turned off, it is determined whether the fourth detecting portion 510*d* is turned off.

In the case where the third detecting portion 510*c* is tuned off and the fourth detecting portion 510*d* is turned on, the sheet bundle is discharged at a sheet discharge speed of 550 mm/s similarly to the first embodiment. In the case where the fourth detecting portion 510*d* is turned off, the height position of the uppermost surface becomes lowered compared to the case where the height position of the uppermost surface becomes lower than a predetermined height and the third detecting portion 510*c* is turned off. Therefore, in the case where the third detecting portion 510*c* is turned off and the fourth detecting portion 510*d* is turned off, the sheet bundle is discharged at a third sheet discharge speed of 700 mm/s faster than 550 mm/s. In the case where the third detecting portion 510*c* and the fourth detecting portion 510*d* are turned on, the sheet bundle is discharged at a sheet discharge speed of 400 mm/s.

Figure 16:
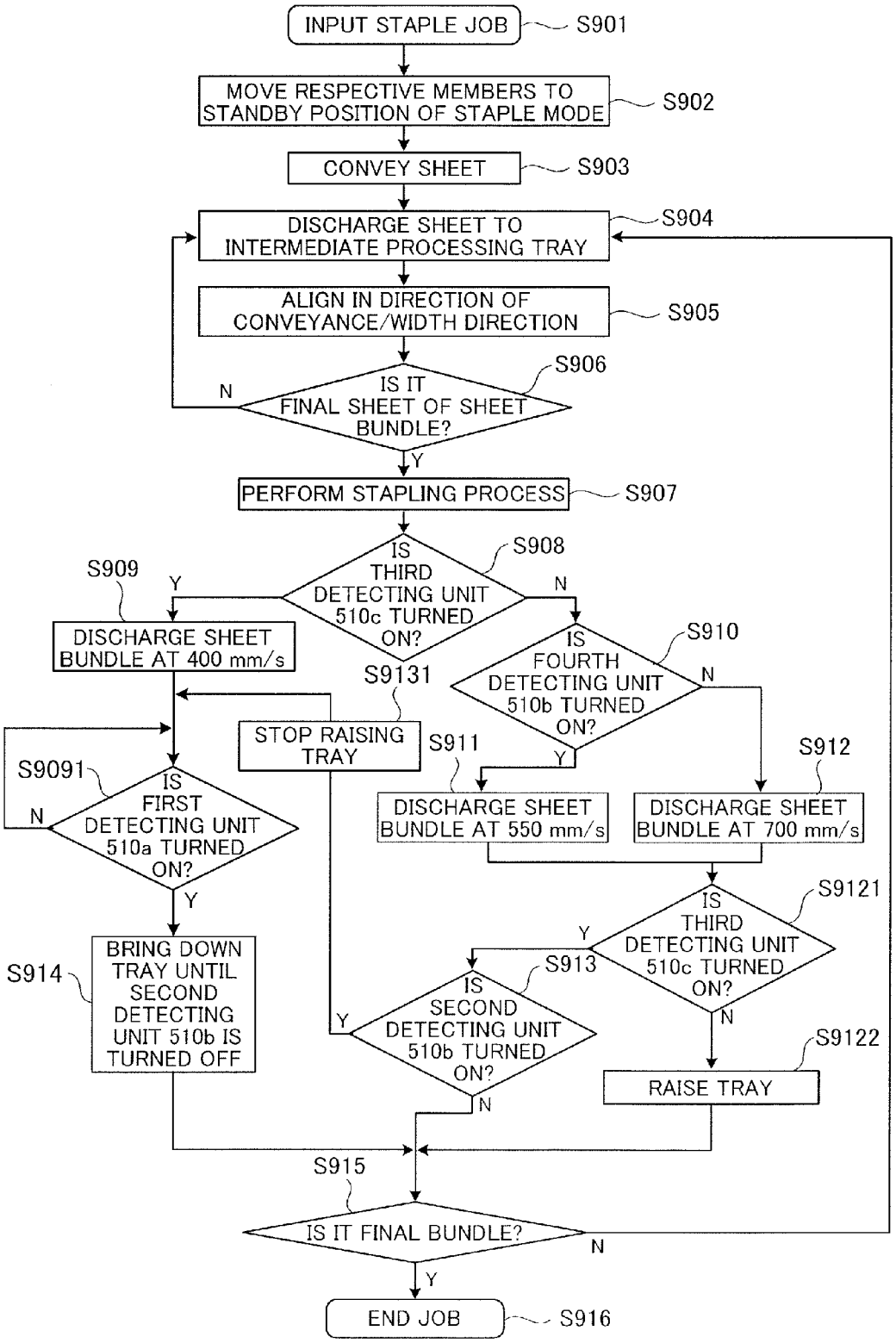
FIG. 16 is a flowchart for describing a control of the second embodiment.

Next, the description will be made using the flowchart illustrated in FIG. 16 about an operation in which the sheet bundle containing an image formed by the color copier 600 and processed by the finisher 100 is discharged by the sheet discharge apparatus 100D and stacked on the tray. It is noted that although the description in this embodiment will be made about a case where the sheet is discharged to the lower tray 137, the sheet may be discharged to the upper tray 136. In addition, the following operation is controlled by the finisher control unit 636.

When the staple job is selected and input from the operating unit 601 of the color copier 600 (S901), the respective members are initialized and move to standby positions of the staple mode (S902). Therefore, the lower tray 137 moves to a position where the second detecting portion is turned off and the third detecting portion is turned on, the second detecting portion and the third detecting portion being illustrated in FIG. 14A or FIG. 14B already described above.

Next, when the sheet is conveyed from the copier body 602 (S903) and discharged onto the intermediate processing tray 138 (S904), the sheet is aligned in the direction of conveyance and the width direction (S905). Thereafter, it is determined whether the discharged sheet is the final sheet of the sheet bundle (S906). When it is determined that the discharged sheet is the final sheet (Y in S906), the stapling process of the sheet bundle is performed (S907), and the sheet bundle subjected to the stapling process is discharged to the lower tray 137.

Before such a bundle discharge operation is performed, the finisher control unit 636 confirms the height position of the uppermost surface of the sheet bundle on the lower tray, and determines the sheet discharge speed according to the height position of the uppermost surface. In order to determine the sheet discharge speed as described above, it is confirmed whether the third detecting portion 510*c* is turned on (S908). In the case where the third detecting portion 510*c* is turned on (Y in S908), the sheet discharge speed is determined as 400 mm/s, and the sheet bundle is discharged at a sheet discharge speed of 400 mm/s (S909).

Next, after the sheet bundle is discharged, it is confirmed whether the first detecting portion 510*a* is turned on (S9091). In a case where the first detecting portion 510*a* is not turned on (N in S9091), the next sheet bundle is discharged. In addition, when the first detecting portion 510*a* is turned on (Y in S9091), the lower tray 137 descends until the second detecting portion 510*b* is turned off (S914). Therefore, the lower tray 137 descends to a position where the subsequent sheet bundle becomes dischargeable. Thereafter, it is confirmed whether the discharged sheet bundle is the final bundle of the job (S915). In a case where the discharged sheet bundle is not the final bundle (N in S915), the processes of S904 to S9091 and S914 to S915 already described above are repeatedly performed. Then, when the final bundle is discharged (Y in S915), the job is ended (S916).

On the other hand, for example, in a case where the sheet bundle stacked on the lower tray 137 is removed in a large quantity and thus the third detecting portion 510*c* is turned off (N in S908), the state of the fourth detecting portion 510*d* is confirmed (S910). In the case where the fourth detecting portion 510*d* is turned on (Y in S910), the sheet discharge speed is determined as 550 mm/s, and the sheet bundle is discharged at a sheet discharge speed of 550 mm/s (S911). In the case where the fourth detecting portion 510*d* is turned off (N in S910), the sheet discharge speed is determined as 700 mm/s, and the sheet bundle is discharged at a sheet discharge speed of 700 mm/s (S912).

Next, after the discharge of the sheet bundle to the lower tray 137 at a sheet discharge speed of 550 mm/s or 700 mm/s is completed, it is confirmed whether the third detecting portion 510*c* is turned on (S9121). In a case where the third detecting portion 510*c* is not turned on (N in S9121), the lower tray 137 is raised (S9122). Thereafter, it is confirmed whether the discharged bundle is the final bundle of the job (S915). In a case where the discharge bundle is not the final bundle (N in S915), the processes of S904 to S908, S910 to S912, S9121, and S9122 already described above are repeatedly performed. Then, when the final bundle is discharged (Y in S915), the job is ended (S916).

When the third detecting portion 510*c* is turned on (Y in S9121), the lower tray 137 is raised up to a position where the second detecting portion 510*b* is turned on, and it is confirmed whether the second detecting portion 510*b* is turned on (S913). In a case where the second detecting portion 510*b* is turned on (Y in S913), the raising of the lower tray 137 is stopped (S9131). Thereafter, it is confirmed whether the first detecting portion 510*a* is turned on (S9091). In a case where the first detecting portion 510*a* is not turned on (N in S9091), the next sheet bundle is discharged. In addition, when the first detecting portion 510*a* is turned on (Y in S9091), the lower tray 137 descends until the second detecting portion 510*b* is turned off (S914). Therefore, the height position of the uppermost surface is returned to the same initial height at the time of initialization. Thereafter, it is confirmed whether the discharged sheet bundle is the final bundle of the job (S915). In a case where the discharged sheet bundle is not the final bundle (N in S915), the operations already described above are repeatedly performed. Then, when the final bundle is discharged (Y in S915), the job is ended (S916).

In a case where the second detecting portion 510*b* is not turned on (N in S913), it is confirmed whether the discharged sheet bundle is the final bundle of the job (S915). In a case where the discharged sheet bundle is not the final bundle (N in S915), the processes of S904 to S908, S910 to S912, S9121, and S913 already described above are repeatedly performed. Then, when the final bundle is discharged (Y in S915), the job is ended (S916).

FIG. 17 is a table showing an experiment result on a relation between the number of staple bundles, a height of the stack surface (the height of the uppermost surface), the sheet discharge speed, a defect of a stacking property, and an occurrence of a paper jam in the sheet discharge apparatus of this embodiment. In FIG. 17, "O" indicates a situation where a defect of a stacking property, a paper jam or the like due to leaning of the sheet do not occur, and "X" indicates a situation where a defect of a stacking property and a paper jam due to the leaning of the sheet occur.

It is noted that, in the height of the stack surface, "Design" indicates that the height of the sheet stack surface of the lower tray 137 is designed to, for example, a height position where the third detecting portion 510*c* illustrated in FIGS. 14A and 14B already described above is turned on and the second detecting portion 510*b* is just turned off. Design −10 mm, Design −30 mm, and Design −50 mm indicate the heights of the stack surfaces when the sheet is stacked and the lower tray 137 is lowered by 10 mm, 30 mm, and 50 mm.

As illustrated in FIG. 17, it is found out that when the sheet bundle is discharged at a uniform sheet discharge speed of 400 mm/s, a defect of a stacking property and a paper jam occur due to the leaning of the sheet according to the number of staple bundles. In other words, in the case where the number of staple bundles is "10" and the heights of the stack surfaces are Design −30 mm and Design −50 mm, and in the case where the number of staple bundles is "50" and the heights of the stack surfaces are Design −10 mm, Design −30 mm, and Design −50 mm, the paper jam occurs. In addition, in the case where the number of staple bundles is "100" and the heights of the stack surfaces are Design −10 mm, Design −30 mm, and Design −50 mm, the paper jam occurs.

With this regard, when the sheet bundle is discharged at a uniform sheet discharge speed 550 mm/s, in the case where the number of staple bundles is "100" and the height of the stack surface is Design −50 mm, the paper jam occurs. However, it can be seen that the paper jam is basically prevented from occurring. When the sheet bundle is discharged at a uniform sheet discharge speed of 700 mm/s, it can be seen that the paper jam can be prevented from occurring.

In FIG. 17, it can be seen that when the sheet discharge speed is set to be fast, the paper jam can be prevented from occurring. However, it is desirable that the sheet discharge speed is set to be slow in order to prevent the stacking property from being degraded due to an increase in jumping amount. Therefore, in this embodiment, the sheet bundle is discharged at 400 mm/s when the height of the stack surface is at the designed height, 550 mm/s when the third detecting portion 510*c* is turned off, and 700 mm/s when the fourth detecting portion 510*d* is turned off.

As described above, in this embodiment, the fourth detecting portion 510*d* is provided below the third detecting portion 510*c*, and the sheet discharge speed is changed in three steps. With this configuration, the sheet discharge speed can be finely changed according to the height position of the uppermost surface. Therefore, the defect of stacking property and the paper jam caused by the leaning of the sheet can be prevented. It is noted that the description in this embodiment has been made about a case where one detecting portion is disposed below the third detecting portion 510*c*, and in a case where a plurality of detecting portions are disposed below the third detecting portion 510*c*, the sheet discharge speed can be more finely changed.

By the way, the description hitherto has been made about the operation of the sheet discharge apparatus in the staple mode, but this disclosure is not limited thereto. The sheet discharge speed may be changed even in a non-staple mode.

Figure 18:
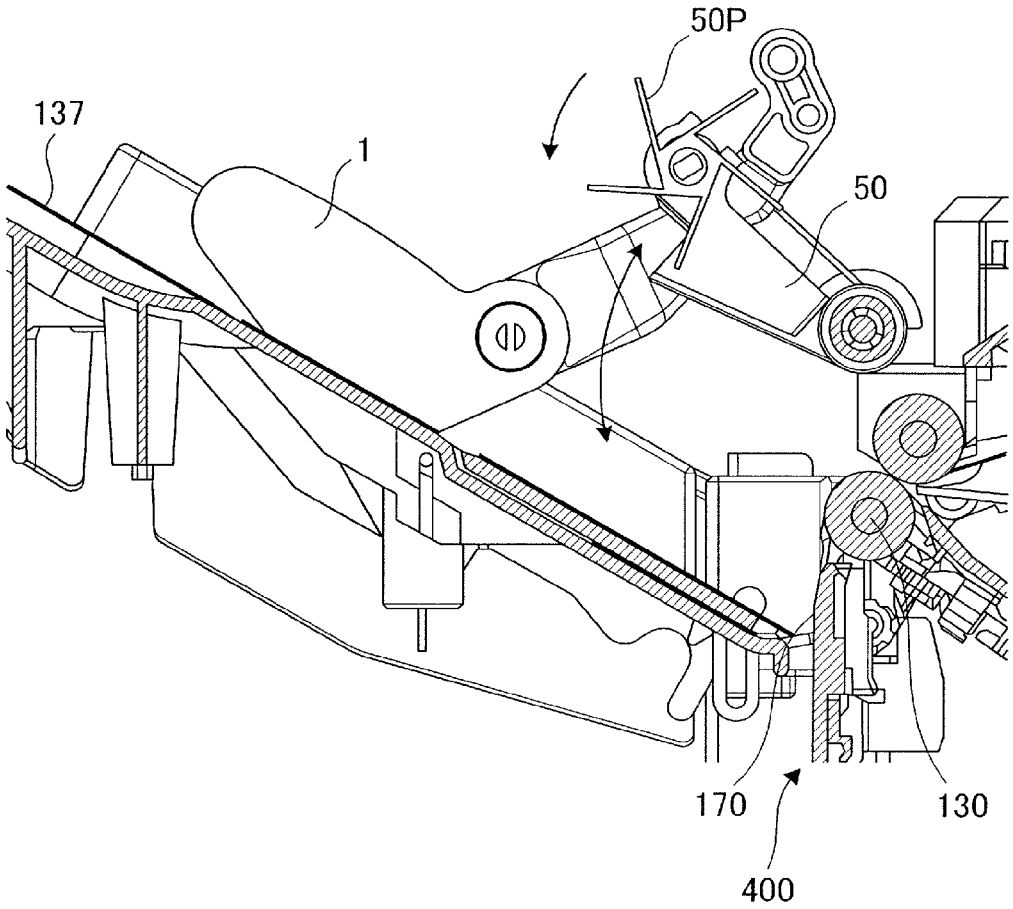
FIG. 18 is a diagram for describing a configuration of a sheet processing apparatus which is provided with a sheet discharge apparatus according to a third embodiment.

Next, the description will be made about a third embodiment of this disclosure in which the sheet discharge speed is changed in the non-staple mode. FIG. 18 is a diagram for describing a configuration of the sheet processing apparatus which is provided with the sheet discharge apparatus according to this embodiment. It is noted that, in FIG. 18, the same symbols as those of FIGS. 11A to 11C already described above indicate the same or corresponding portions.

As illustrated in FIG. 18, a returning holder 50 which is rotatable in the vertical direction is provided above the lower tray 137. A tray paddle 50P is rotatably supported in a counterclockwise direction to a pivotal end of the returning holder 50. In addition, an abutment portion 170 is provided in an outer wall surface of the finisher body 400. Then, when the sheet is stacked on the lower tray, the tray paddle 50P is rotated and the returning holder 50 is rotated downward. Therefore, the tray paddle 50P abuts on the sheet while being rotated, and causes the sheet to abut onto the abutment portion 170 to be aligned in the discharge direction. It is noted that after the sheet is aligned in the discharge direction in this way, the width direction arranging member 1 descends to move to the side in the width direction of the sheet stacked on the lower tray 137 as already described above, and thereafter, the width direction arranging member 1 is moved in the width direction and the position of the sheet in the width direction is aligned.

In this embodiment, the finisher 100 is provided with the staple mode and the non-staple mode. As the non-staple mode, there are a mode of aligning and discharging the sheet bundle to the lower tray 137 through the intermediate processing tray 138, and a mode of directly discharging the sheet to the lower tray 137. In the case of the mode of directly discharging the sheet to the lower tray 137, the bundle discharge roller pair 130 nips and discharges the sheet one by one. In the case of the mode of discharging the sheet bundle to the lower tray 137 through the intermediate processing tray 138, the bundle discharge roller pair 130 nips and discharges the sheet bundle. In the case of the mode of nipping and discharging the sheet one by one, the amount of the hanging-down is reduced as the number of nipped sheets is reduced compared to the case of the mode of discharging the sheet bundle. Therefore, in this embodiment, the sheet discharge speed in the mode of directly discharging the sheet to the lower tray 137 is set to 350 mm/s or 500 mm/s slower than the sheet discharge speeds 450 mm/s and 600 mm/s in the mode of discharging the sheet bundle to the lower tray 137.

Figure 19:
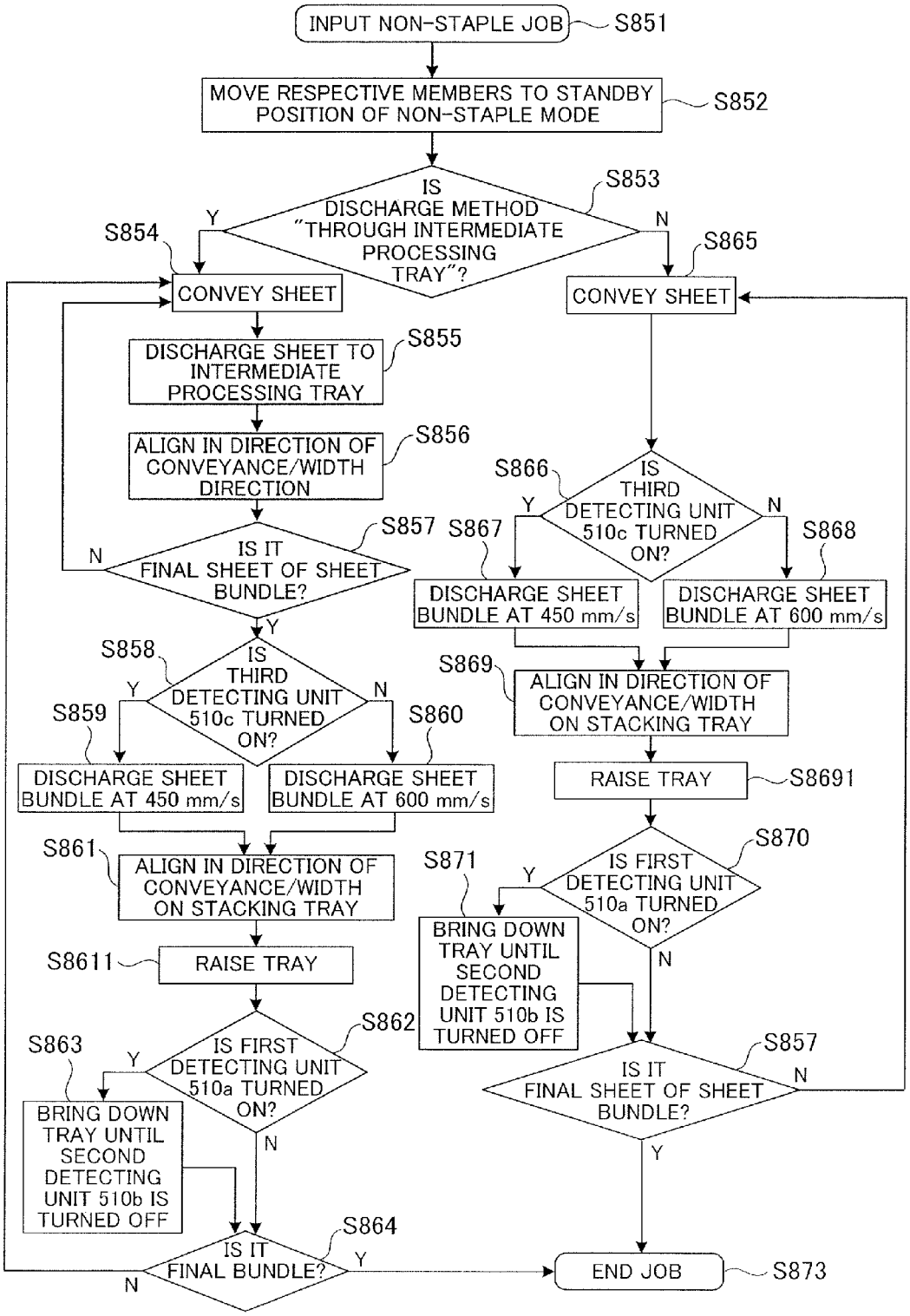
FIG. 19 is a flowchart for describing a control of the third embodiment.

Next, the description will be made about an operation of discharging and stacking, onto the tray using the sheet discharge apparatus 100D, the sheet containing an image formed by the color copier 600 and passed through the finisher 100 in the non-staple mode using the flowchart illustrated in FIG. 19. The following operation is controlled by the finisher control unit 636.

When the non-staple job is selected and input from the operating unit 601 of the color copier 600 (S851), the respective members are initialized and move to standby positions of the non-staple mode (S852). Next, it is determined whether a discharge method in the non-staple mode is performed through a processing tray (S853).

In the case of the discharge method through the intermediate processing tray (Y in S853), the sheet is conveyed from the copier body 602 (S854). When the trailing end of the sheet is released from the nip of the lower sheet discharge roller pair 128, the sheet is discharged onto the intermediate processing tray 138 (S855). Thereafter, the sheet is aligned in the direction of conveyance and the width direction (S856). It is determined whether the next discharging sheet is the final sheet of the sheet bundle (S857). When the discharging sheet is the final sheet (Y in S857), the sheet bundle is discharged to the lower tray 137.

Before such a sheet bundle discharge operation, the finisher control unit 636 confirms whether the third detecting portion 510*c* is turned on (S858). In the case where the third detecting portion 510*c* is turned on (Y in S858), the sheet discharge speed is determined as 400 mm/s, and the sheet bundle is discharged at a sheet discharge speed of 400 mm/s (S859). In addition, in the case where the third detecting portion 510*c* is turned off (N in S858), the sheet discharge speed is determined as 550 mm/s, and the sheet bundle is discharged at a sheet discharge speed of 550 mm/s (S860).

Next, the position of the sheet bundle discharged to the lower tray 137 is aligned in the direction of sheet conveyance by the tray paddle 50P and aligned in the width direction of the sheet by the width direction arranging member 1 (S861). Next, after the sheet bundle is discharged, it is determined whether the third detecting portion 510*c* is turned on. In a case where the third detecting portion 510*c* is not turned on, the tray is raised similarly to the first and second embodiments already described above (S8611). It is confirmed whether the first detecting portion 510*a* is turned on (S862). In a case where the first detecting portion 510*a* is not turned on (N in S862), the next sheet bundle is discharged. In addition, when the first detecting portion 510*a* is turned on (Y in S862), the lower tray 137 descends until the second detecting portion 510*b* is turned off (S863). Therefore, the lower tray 137 descends to a position where the subsequent sheet bundle becomes dischargeable. Thereafter, it is confirmed whether the discharged sheet bundle is the final bundle of the job (S864). In a case where the discharged sheet bundle is not the final bundle (N in S864), the operations already described above are repeatedly performed. Then, when the final bundle is discharged (Y in S864), the job is ended (S873).

In a case where the discharge method in the non-staple mode is a direct discharge of the sheet to the lower tray 137 without passing through the intermediate processing tray 138 (N in S853), when the sheet is conveyed from the copier body 602 (S865), the sheet is discharged to the lower tray 137. Herein, before such a sheet discharging operation is performed, it is confirmed whether the third detecting portion 510*c* is turned on (S866). In the case where the third detecting portion 510*c* is turned on (Y in S866), the sheet discharge speed is determined as 350 mm/s, and the sheet is discharged at a sheet discharge speed of 350 mm/s (S867). In addition, in the case where the third detecting portion 510*c* is turned off (N in S866), the sheet discharge speed is determined as 500 mm/s, and the sheet is discharged at a sheet discharge speed of 500 mm/s (S868).

Next, the position of the sheet discharged to the lower tray 137 is aligned in the direction of sheet conveyance by the tray paddle 50P and aligned in the width direction by the width direction arranging member 1 (S869). Thereafter, it is determined whether the third detecting portion 510*c* is turned on. In a case where the third detecting portion 510*c* is not turned on, the tray is raised similarly to the first and second embodiments already described above (S8691). It is confirmed whether the first detecting portion 510*a* is turned on (S870). In a case where the first detecting portion 510*a* is not turned on (N in S870), the next sheet bundle is discharged. In addition, when the first detecting portion 510*a* is turned on (Y in S870), the lower tray 137 descends until the second detecting portion 510*b* is turned off (S871). Therefore, the height position of the uppermost surface is returned to the same initial height at the time of initialization. Thereafter, it is confirmed whether the discharged sheet is the final sheet of the discharged final bundle of the job (S872). In a case where the discharged sheet is not the final sheet (N in S872), the operations already described above are repeatedly performed. Then, when the final sheet of the final bundle is discharged (Y in S872), the job is ended (S873).

In this way, in this embodiment, the sheet discharge speed is changed even in the non-staple mode. Furthermore, the sheet discharge speed is changed according to a discharge state of the sheet in the non-staple mode. More specifically, the second sheet discharge speed (the discharge speed of the sheet in a case where the sheet discharged to the lower tray 137 is removed) includes a second sheet discharge speed in a case where the discharging portion 130 discharges the sheet bundle and a second sheet discharge speed in a case where the discharging portion 130 discharges the sheet one by one, which is slower than the second sheet discharge speed in a case where the discharging portion 130 discharges the sheet bundle. Then, the finisher control unit 636 switches the sheet discharge speed between the second sheet discharge speed in a case where the sheet bundle is discharged and the second sheet discharge speed in a case where the sheet is discharged one by one based on whether the discharging portion 130 discharges the sheet one by one or discharges the sheet bundle. Therefore, the sheet discharge speed can be finely changed according to the height position of the uppermost surface even in the non-staple mode. Accordingly, the defect of stacking property and the paper jam caused by the leaning of the sheet can be prevented.

It is noted that the sheet discharge speed described hitherto in the first to third embodiments may be set according to the number of sheets forming the sheet bundle, a sheet size, and a sheet type. In addition, the description has been made about the sheet discharge apparatus provided in the sheet processing apparatus, but this disclosure is not limited thereto and may be applied to a sheet discharge apparatus provided in an image forming apparatus.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-154004, filed Aug. 4, 2015, which is hereby incorporated by reference herein in its entirety.

What is claimed is:

1. A sheet discharge apparatus comprising:

a discharging portion configured to discharge a sheet;

a sheet stacking portion, configured to be moved up and down, on which the sheet discharged by the discharging portion is stacked;

a moving unit configured to move the sheet stacking portion;

a control portion configured to control the moving unit such that a height position of an uppermost sheet stacked on the sheet stacking portion becomes a first height position; and a sheet detection portion configured to detect that the height position of the uppermost sheet is lower than a second height position lower than the first height position, wherein the control portion sets a sheet discharge speed of the discharging portion to a first sheet discharge speed in a case where the uppermost sheet is at the first height position, and wherein the control portion sets the sheet discharge speed to a second sheet discharge speed faster than the first sheet discharge speed in a case where the sheet detection portion detects that the height position of the uppermost sheet is lower than the second height position.

2. The sheet discharge apparatus according to claim 1, wherein, in response to an input of a signal indicating that the height position of the uppermost sheet becomes lower than the second height position from the sheet detection portion, the control portion discharges the sheet at the second sheet discharge speed and controls the moving unit to raise the sheet stacking portion until the height position of the uppermost sheet becomes the first height position.

3. The sheet discharge apparatus according to claim 1, wherein the control portion sets the sheet discharge speed of the discharging portion when the discharging portion starts to discharge the sheet to be faster than the second sheet discharge speed, and wherein the control portion decelerates the sheet discharge speed of the discharging portion such that the sheet discharge speed when a trailing end of the sheet is discharged from the discharging portion becomes one of the first sheet discharge speed and the second sheet discharge speed.

4. The sheet discharge apparatus according to claim 1, wherein the first sheet discharge speed and the second sheet discharge speed are set according to at least one of a sheet size and a sheet type.

5. The sheet discharge apparatus according to claim 1, further comprising:

another sheet detection portion configured to detect that the height position of the uppermost sheet becomes less than a third height position lower than the second height position, wherein the control portion controls the sheet discharge speed to be a third sheet discharge speed faster than the second sheet discharge speed in response to an input of a signal indicating that the height position of the uppermost sheet becomes less than the third height position from the another sheet detection portion.

6. The sheet discharge apparatus according to claim 1, further comprising a sheet bundle forming portion configured to be provided upstream, in a sheet discharge direction, of the discharging portion and forms a sheet bundle, wherein the discharging portion is capable of discharging the sheet bundle formed by the sheet bundle forming portion to the sheet stacking portion.

7. The sheet discharge apparatus according to claim 6, wherein the second sheet discharge speed includes a second sheet discharge speed in a case where the discharging portion discharges the sheet bundle and a second sheet discharge speed in a case where the discharging portion discharges the sheet one by one, which is slower than the second sheet discharge speed in a case where the discharging portion discharges the sheet bundle, and wherein the control portion switches the second sheet discharge speed between the second sheet discharge speed in the case of discharging the sheet bundle and the second sheet discharge speed in the case of discharging the sheet one by one based on whether the discharging portion discharges the sheet one by one or the sheet bundle.

8. The sheet discharge apparatus according to claim 7, wherein the first sheet discharge speed and the second sheet discharge speed are set according to at least one of the number of sheets forming the sheet bundle, a sheet size, and a sheet type.

9. The sheet discharge apparatus according to claim 1, further comprising another sheet detection portion configured to detect that the height position of the uppermost sheet stacked on the sheet stacking portion is the first height position, wherein the control portion controls the moving unit based on a detection result of the another sheet detection portion.

10. A sheet discharge apparatus comprising:

a discharging portion configured to discharge a sheet;

a sheet stacking portion, configured to be moved up and down, on which the sheet discharged by the discharging portion is stacked;

a moving unit configured to move the sheet stacking portion; and a control portion configured to control the moving unit such that a height position of an uppermost sheet stacked on the sheet stacking portion becomes a predetermined height position, wherein the control portion sets a sheet discharge speed of the discharging portion to a first sheet discharge speed in a case where the height position of the uppermost sheet is the predetermined height position, and wherein the control portion sets the sheet discharge speed to a second sheet discharge speed faster than the first sheet discharge speed in a case where the sheet is discharged while the sheet stacking portion is raised such that the height position of the uppermost sheet becomes the predetermined height position.

11. An image forming apparatus comprising:

an image forming portion configured to form an image in a sheet;

a discharging portion configured to discharge the sheet on which the image formed by the image forming portion;

a sheet stacking portion, configured to be moved up and down, on which the sheet discharged by the discharging portion is stacked;

a moving unit configured to move the sheet stacking portion;

a control portion configured to control the moving unit such that a height position of an uppermost sheet stacked on the sheet stacking portion becomes a first height position; and a sheet detection portion configured to detect that the height position of the uppermost sheet is lower than a second height position lower than the first height position, wherein the control portion sets a sheet discharge speed of the discharging portion to a first sheet discharge speed in a case where the sheet detection portion detects that the height position of the uppermost sheet is above the second height position, and wherein the control portion sets the sheet discharge speed to a second sheet discharge speed faster than the first sheet discharge speed in a case where the sheet detection portion detects that the height position of the uppermost sheet is below the second height position.

* * * * *